US012698943B2

(12) United States Patent
Geissele et al.

(10) Patent No.: US 12,698,943 B2
(45) Date of Patent: Aug. 4, 2026

(54) TRIGGER ASSEMBLY WITH SAFETY FEATURES

(71) Applicant: WHG PROPERTIES, LLC, North Wales, PA (US)

(72) Inventors: William H. Geissele, Lower Gwynedd, PA (US); William Quigley, Souderton, PA (US)

(73) Assignee: WHG PROPERTIES, LLC, North Wales, PA (US)

( * ) Notice: Subject to any disclaimer, the term of this patent is extended or adjusted under 35 U.S.C. 154(b) by 0 days.

(21) Appl. No.: 18/813,900

(22) Filed: Aug. 23, 2024

(65) Prior Publication Data

US 2024/0418469 A1 Dec. 19, 2024

Related U.S. Application Data

(63) Continuation of application No. 18/066,740, filed on Dec. 15, 2022, now Pat. No. 12,104,867.

(51) Int. Cl.
*F41A 19/10* (2006.01)
*F41A 17/46* (2006.01)

(52) U.S. Cl.
CPC ..... *F41A 19/10* (2013.01); *F41A 17/46* (2013.01)

(58) Field of Classification Search
CPC ..... F41A 19/15
USPC ..... 42/69.03; 89/141, 142, 146, 147
See application file for complete search history.

(56) References Cited

U.S. PATENT DOCUMENTS 5,501,123 A 3/1996 Swann et al.
6,131,324 A 10/2000 Jewell
7,600,338 B2 10/2009 Geissele
8,069,602 B2 12/2011 Geissele
9,310,150 B1 4/2016 Geissle
9,518,793 B1 12/2016 Stakes
9,618,289 B1 4/2017 Geissele
9,658,017 B2 * 5/2017 Alicea ..... F41A 19/59
9,927,197 B1 3/2018 Geissele
10,330,413 B2 6/2019 Williams et al.
10,337,816 B2 7/2019 Geissele
10,488,134 B2 11/2019 Olson et al.
10,837,728 B2 11/2020 Olson
11,598,599 B2 3/2023 Bray
(Continued)

FOREIGN PATENT DOCUMENTS

EP 3516321 B1 3/2022

OTHER PUBLICATIONS

Extended European Search Report for European Patent Application No. 23210360.0 dated May 13, 2024 (7 pages).

*Primary Examiner* — Reginald S Tillman, Jr.
(74) *Attorney, Agent, or Firm* — Alston & Bird LLP

(57) ABSTRACT

Provided are a trigger assembly, firearm, and various methods and components. An example assembly includes a lower trigger body comprising a trigger lever; a disconnector rotatable relative to the lower trigger body; a trigger tower rotatable relative to the lower trigger body and the disconnector, the trigger tower defining a trigger tower hook; and a hammer defining a hammer sear hook configured to engage the trigger tower hook to hold the hammer in a cocked position. In response to application of a force to the trigger lever, the lower trigger body may rotate and cause the trigger tower to rotate to release the trigger tower hook from the hammer sear hook.

19 Claims, 21 Drawing Sheets

(56) References Cited

U.S. PATENT DOCUMENTS

| | | | | |
|---|---|---|---|---|
| 11,629,926 | B2 * | 4/2023 | Elftmann, Jr. ..... | F41A 19/14<br>89/136 |
| 2016/0161202 | A1 | 6/2016 | Larue | |
| 2019/0271518 | A1 | 9/2019 | McKillips et al. | |

* cited by examiner

TRIGGER ASSEMBLY WITH SAFETY FEATURES

CROSS-REFERENCE TO RELATED APPLICATIONS

This application is a continuation of and claims the benefit of U.S. application Ser. No. 18/066,740, filed Dec. 15, 2022, the contents of which are herein incorporated by reference in its entirety.

TECHNICAL FIELD

This application relates to firearm trigger assemblies, including trigger assemblies capable of re-cocking the firearm with a safety selector in the safe position.

BACKGROUND

Firearms typically ignite a propellant stored in a cartridge using a hammer and firing pin to impact a primer or primer-containing portion of the cartridge. A trigger assembly causes the hammer to be released from a cocked position to strike the firing pin by rotating the trigger until the hammer is released. A selector switch may be rotated into a safe position to prevent the trigger from rotating and to avoid inadvertent discharge. In some instances, the selector switch may also prevent re-cocking the firearm when the selector switch is in the safe position, which may create a potentially dangerous situation when a user re-cocks the firearm with the selector switch out of the safe position. The inventors have identified numerous deficiencies with standard trigger assemblies and these existing technologies in the field, the remedies for which are the subject of the embodiments described herein.

BRIEF SUMMARY

In general, embodiments of the present disclosure provided herein include trigger assemblies, firearms, and associated methods for improving firearm safety. In some embodiments, various embodiments of the present disclosure provide a trigger assembly capable of being re-cocked while a safety selector switch is in the safe position.

Various embodiments of the present disclosure may include a trigger assembly comprising a lower trigger body comprising a trigger lever; a disconnector rotatable relative to the lower trigger body; a trigger tower rotatable relative to the lower trigger body and the disconnector, wherein the trigger tower defines a trigger tower hook; and a hammer defining a hammer sear hook configured to engage the trigger tower hook to hold the hammer in a cocked position. In some embodiments, in response to application of a force to the trigger lever, the lower trigger body may be configured to rotate and cause the trigger tower to rotate to release the trigger tower hook from the hammer scar hook.

In some embodiments, each of the lower trigger body and the trigger tower rotates about a common trigger pivot pin. In some embodiments, the trigger assembly may include a selector switch configurable between at least a safe position and a fire position, wherein in the safe position, the selector switch is configured to prevent the lower trigger body from causing the trigger tower hook to release from the hammer sear hook. In the safe position, the hammer may be configured to be movable from an uncocked position to the cocked position. The hammer may be configured to rotate the trigger tower when moving from the uncocked position to the cocked position to allow the hammer sear hook to pass around and engage the trigger tower hook. In response to a force by a trigger tower spring, the trigger tower may be configured to rotate the trigger tower hook towards a butt-stock end of the trigger assembly after the hammer sear hook passes around the trigger tower hook to cause the hammer sear hook to engage the trigger tower hook. The hammer may be configured to rotate the trigger tower when moving from the uncocked position to the cocked position without causing the lower trigger body to rotate. The selector switch may be configured to movable between the safe position and the fire position both when the hammer is in the cocked position and when the hammer is in the uncocked position.

In some embodiments, the trigger tower defines an inner slot of the trigger tower. A portion of the disconnector may be configured to be disposed in the inner slot of the trigger tower. The lower trigger body may define a trigger trough, and a second portion of the disconnector may be configured to be disposed in the trigger trough. In some embodiments, the hammer defines a recess along a rear surface opposite a hammer strike plate, and a trigger tower nose of the trigger tower is configured to at least partially enter the recess. In some embodiments, the hammer comprises two hammer sears each defining a recess into which a lower trigger nose of the lower trigger body is configured to insert. In some embodiments, a first sear of the two hammer sears is configured to rotationally align with the lower trigger nose of the lower trigger body in an instance in which the hammer is in the cocked position, and a second sear of the two hammer sears is configured to rotationally align with the lower trigger nose of the lower trigger body in an instance in which the hammer is in an uncocked position. In some embodiments, the disconnector, trigger tower, and lower trigger body define a two-stage firing assembly.

Various embodiments of the present disclosure may include a firearm comprising a trigger assembly according to the embodiments disclosed herein. In some embodiments, the trigger assembly may be engaged with a lower receiver of the firearm. The firearm may be, for example, an AR15 platform rifle or M4 platform rifle.

In various embodiments of the present disclosure, a method of operating a trigger assembly of a firearm may be provided. The trigger assembly may include a lower trigger body comprising a trigger lever; a disconnector rotatable relative to the lower trigger body; a trigger tower rotatable relative to the lower trigger body and the disconnector, wherein the trigger tower defines a trigger tower hook; and a hammer defining a hammer sear hook. The method may include engaging the trigger tower hook to hold the hammer in a cocked position; and in response to application of a force to the trigger lever, the lower trigger body rotates and cause the trigger tower to rotate to release the trigger tower hook from the hammer sear hook.

In some embodiments, the trigger assembly may include a selector switch configurable between at least a safe position and a fire position. In such embodiments, the method may include rotating the selector switch from the fire position to the safe position. In the safe position, the selector switch may prevent the lower trigger body from causing the trigger tower hook to release from the hammer sear hook in response to the force.

In some embodiments, the trigger assembly further comprises a selector switch configurable between at least a safe position and a fire position. In such embodiments, the method may include, in an instance in which the selector switch is in the safe position, rotating the hammer from an uncocked position to the cocked position.

In some embodiments, the trigger assembly may include a selector switch configurable between at least a safe position and a fire position. In such embodiments, the method may include, in an instance in which the selector switch is in the fire position and the hammer is in an uncocked position, rotating the selector switch to the safe position and subsequently rotating the hammer to the cocked position.

The above summary is provided merely for purposes of summarizing some example embodiments to provide a basic understanding of some aspects of the present disclosure. Accordingly, it will be appreciated that the above-described embodiments are merely examples and should not be construed to narrow the scope or spirit of the present disclosure in any way. It will be appreciated that the scope of the present disclosure encompasses many potential embodiments in addition to those here summarized, some of which will be further described below. Other features, aspects, and advantages of the subject matter will become apparent from the description, the drawings, and the claims.

DETAILED DESCRIPTION

Figure 1:
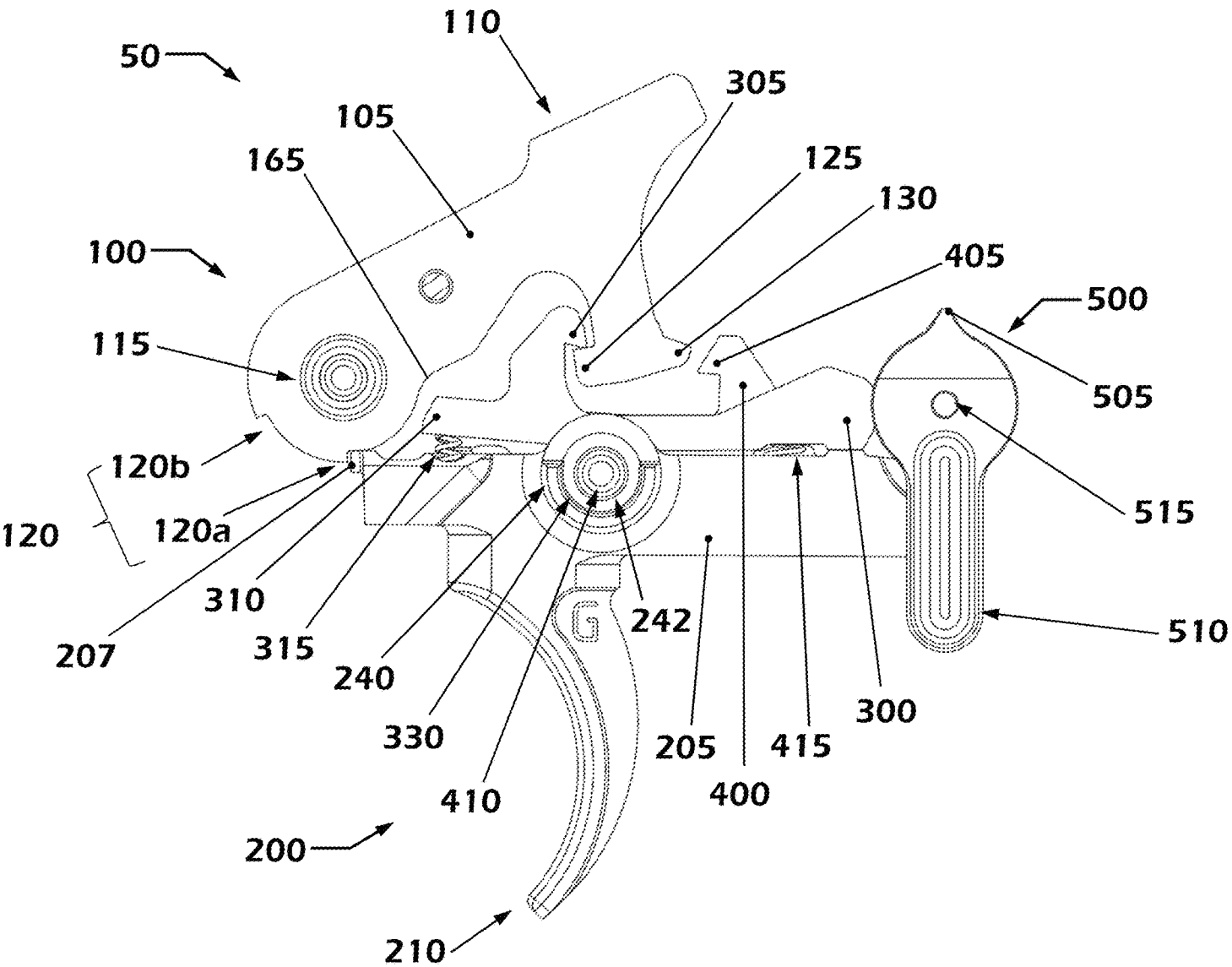
FIG. 1 illustrates a side view of a trigger assembly in accordance with various embodiments of the present disclosure.

Some example embodiments of the present disclosure will now be described more fully hereinafter with reference to the accompanying drawings, in which some, but not all, embodiments of the inventions are shown. Like reference numerals refer to like elements throughout. Indeed, various embodiments of the present disclosure may be embodied in many different forms and should not be construed as limited to the embodiments set forth herein. Rather, these embodiments are provided so that this disclosure will satisfy applicable legal requirements.

As used herein, the word "example" or "exemplary" is used herein to mean "serving as an example, instance, or illustration." Any implementation described herein as "example" or "exemplary" is not necessarily to be construed as preferred or advantageous over other implementations.

As used herein, terms such as "front," "rear," "top," etc. are used for explanatory purposes in the examples provided below to describe the relative position of certain components or portions of components. As used herein, the term "or" is used in both the alternative and conjunctive sense, unless otherwise indicated. The term "along," and similarly utilized terms, means near or on, but not necessarily requiring directly on an edge or other referenced location. The terms "approximately," "generally," and "substantially" refer to within manufacturing and/or engineering design tolerances for the corresponding materials and/or elements unless otherwise indicated. The use of such terms is inclusive of and is intended to allow independent claiming of the specific values listed. Thus, use of any such aforementioned terms, or similarly interchangeable terms, should not be taken to limit the spirit and scope of embodiments of the present disclosure.

The figures are not drawn to scale and are provided merely to illustrate some example embodiments of the inventions described herein. The figures do not limit the scope of the present disclosure or the appended claims. Several aspects of the example embodiments are described below with reference to example applications for illustration. It should be understood that numerous specific details, relationships, and methods are set forth to provide a full understanding of the example embodiments. One having ordinary skill in the relevant art, however, will readily recognize that the example embodiments can be practiced without one or more of the specific details or with other methods. In other instances, well-known structures and/or operations are not shown in detail to avoid obscuring the example embodiments.

Exemplary Trigger Assembly

Provided herein are trigger assemblies, firearms, and associated methods for improving firearm safety. In particular, various embodiments of the present disclosure provide a trigger assembly capable of being re-cocked while a safety selector switch is in the safe position. For example, the selector switch of a firearm, such as an AR15 platform weapon, an M4 platform weapon, and/or a similar style weapon (e.g., an assault type weapon), may include a pin structured to contact a portion of the trigger assembly when in a safe position to prevent the finger-actuatable trigger lever from rotating.

In some instances, a trigger tower may be integrally formed with the trigger lever as a single piece. The trigger tower may be configured to engage the hammer to hold the hammer in a cocked position; however, rotating the hammer from an uncocked position to the cocked position may thereby impinge on the trigger tower. In an instance in which the trigger tower is formed as a single piece with the trigger lever, the hammer may be unable to rotate the trigger tower out of the way during re-cocking when the selector switch in the safe position. In such instances, the firearm may be incapable of re-cocking while the selector switch is in the safe position or may at least cause wear, binding, or other undesirable effects on the trigger components when attempting to re-cock the firearm with the selector switch in the safe position.

Embodiments of the present disclosure may include separate trigger tower and lower trigger body including the trigger lever. The trigger tower and lower trigger body may be movable relative to each other to allow the trigger tower to deflect during re-cocking without moving the lower trigger body, which may allow the selector switch to be in the safe position during re-cocking. In some embodiments, the trigger assembly may be a two-stage trigger assembly configured to change pull weights between a first firing phase and a second firing phase.

Figure 20:
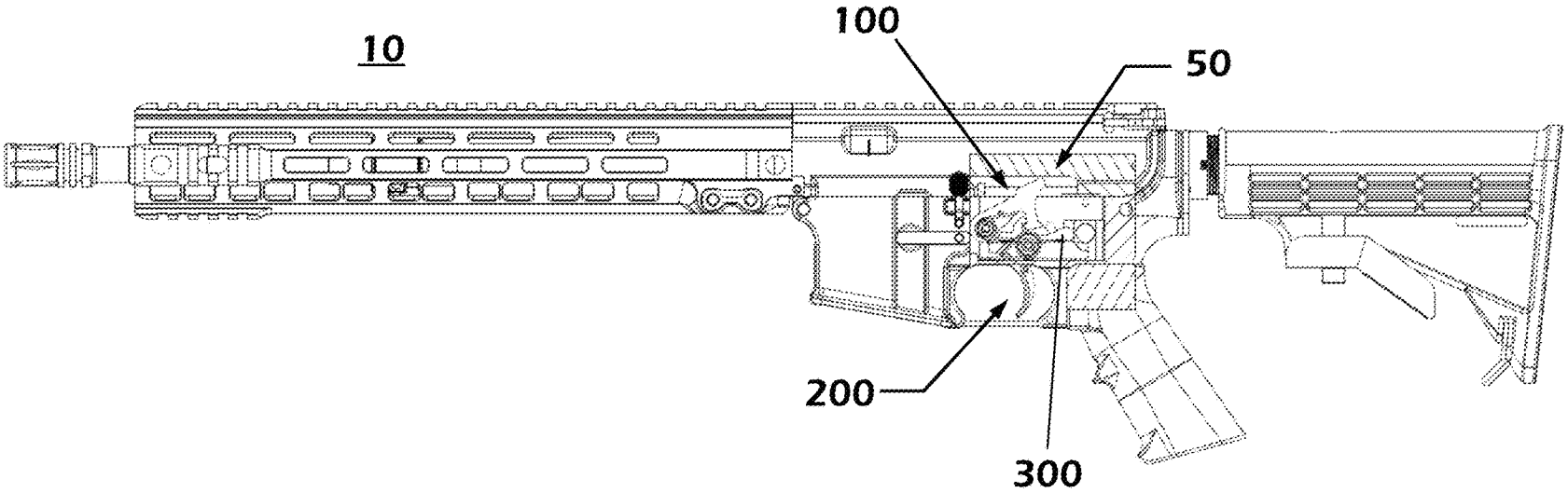
FIG. 20 illustrates a side view of a firearm comprising cutaway illustration of a trigger assembly in accordance with various embodiments of the present disclosure.
Figure 21:
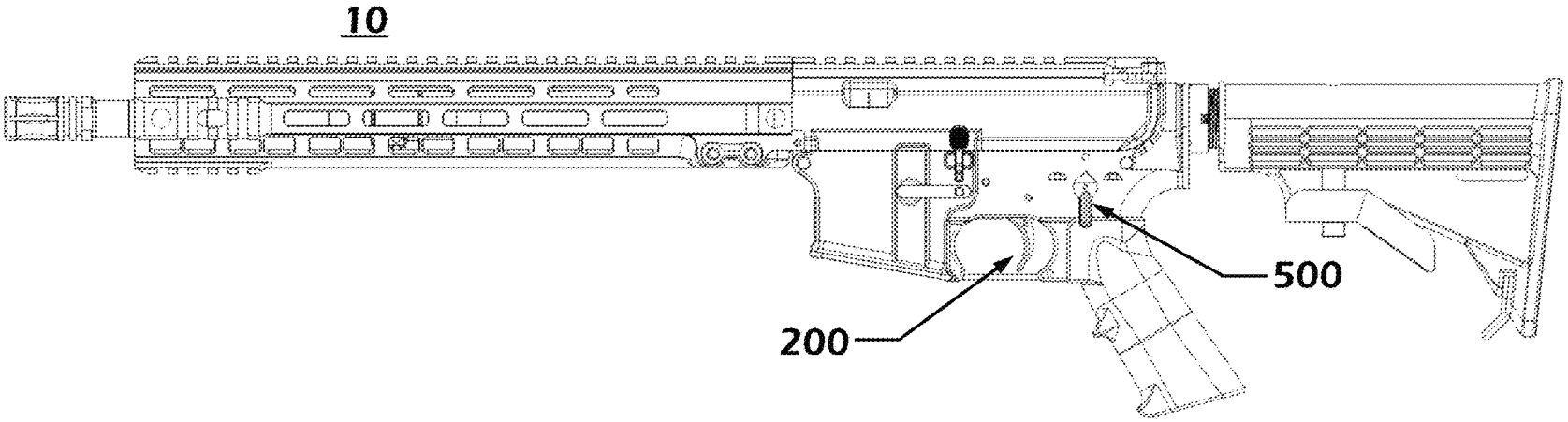
FIG. 21 illustrates a side view of a firearm in accordance with various embodiments of the present disclosure.

FIGS. 20-21 illustrate an example firearm 10 in accordance with various embodiments of the disclosure. FIG. 20 illustrates a cutaway portion showing a trigger assembly 50 in accordance with various embodiments of the disclosure. FIGS. 1-5 illustrate the trigger assembly 50 in a plurality of operational positions in accordance with various example embodiments of the present disclosure. In various example embodiments, a trigger assembly 50 may include a hammer assembly 100, a trigger subassembly 200, and a selector switch 500. The hammer assembly 100 may include a hammer 105, a hammer pivot pin 115, and a hammer spring (e.g., hammer spring 135 shown in FIGS. 8A-8C). The hammer 105 may be configured to pivot about the hammer pivot pin 115 from a cocked position (shown in FIG. 1) to an uncocked (e.g., discharged) position (shown in FIG. 2), forcing the hammer strike plate 110 to rotate toward and strike a firing pin. In some embodiments, the hammer 105 may comprise a plurality of sears 120 disposed rotationally about the axis of the hammer pivot pin 115 to engage the lower trigger body 205 as described herein.

The trigger subassembly 200 may include a lower trigger body 205, a trigger tower 300, a disconnector 400, and trigger pivot pin 410. The lower trigger body 205 may pivot about the trigger pivot pin 410 following user input onto a trigger lever 210 opposing a spring force (e.g., a force from trigger spring 220 shown in FIGS. 13A-13B. In some embodiments, the trigger subassembly 200 may be configured for single-stage operation. The trigger subassembly 200 may be configured for multi-stage (e.g., two stage) trigger operation, whereby a pull weight of the trigger during a first phase (e.g., rotation of the trigger lever 210 from a starting, forwardmost position until the disconnector 400 contacts the hammer 105) is less than a pull weight of the trigger during a second phase (e.g., rotation of the trigger lever 210 from contact between the disconnector 400 and the hammer 105 until release of the hammer 105). The trigger tower 300 may pivot about the trigger pivot pin 410. In some embodiments, the trigger tower 300 is configured with an inner slot of the trigger tower (e.g., inner slot 325 shown in FIGS. 16A, 16C, 17A, 17C, and 17D) to provide a cavity for the disconnector 400 to also pivot about the trigger pivot pin 410. In some embodiments, portions of the trigger tower 300 and disconnector 400 may be disposed in a trigger trough 230 defined by the lower trigger body 205, such that the lower trigger body 205, the trigger tower 300, and the disconnector 400 may each rotate relative to each other about a common axis (e.g., the axis of the trigger pivot pin 410).

Figure 4:
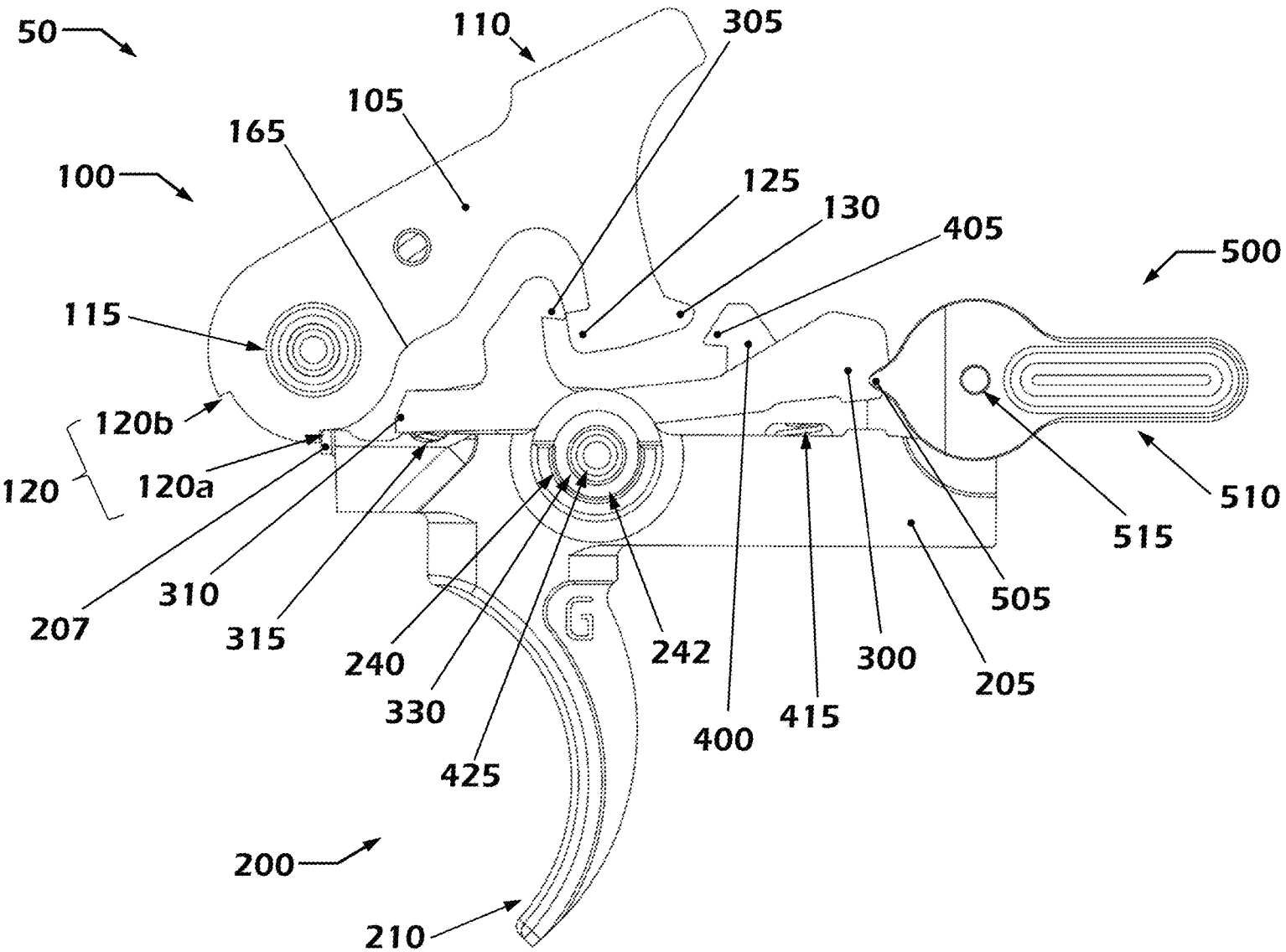
FIG. 4 illustrates a side view of a trigger assembly in accordance with various embodiments of the present disclosure.

The trigger tower 300 may include a trigger tower nose 310. One or more trigger tower springs 315 may engage an underside of the trigger tower 300 at a location between the trigger tower nose 310 and the pivot axis of the trigger pivot pin 410. The trigger tower spring(s) 315 may thereby apply a spring force between the trigger tower 300 and the lower trigger body 205, which may assist in maintaining the orientation of the trigger tower 300 relative to the lower trigger body 205 as described herein. The trigger tower 300 may pivot about the trigger pivot pin 410. In an example embodiment, the trigger tower 300 pivots to a point where a contact surface (e.g., trigger tower stop 312 shown in FIG. 13A) of the trigger tower 300 rests against a surface (e.g., first lower trigger body stop 311 shown in FIG. 13B) of the lower trigger body 205. The contact surfaces 311, 312 may be disposed on an opposite side of the pivot axis from the trigger tower spring 315. In an example embodiment, the trigger tower 300 may pivot in the rotational direction opposing the force of the trigger tower spring 315 relative to the lower trigger body 205 in response to a force from the hammer 105 as the hammer is forced into the cocked orientation while the selector switch is enabled (e.g., as shown in FIG. 4), which may cause the contact surfaces 311, 312 of the trigger tower 300 and lower trigger body 205 to separate and the trigger tower and lower trigger body to rotate relative to each other.

The selector switch 500 may include a selector switch directional indicator 505 configured to indicate the selected operation of the trigger assembly 50. The selector switch directional indicator 505 may be toggled by a user using a selector switch lever 510. The selector switch lever 510 may pivot about an axis of a selector switch pin 515, which lever and pin may be rigidly connected to each other. The selector switch 500 may be rotatable between at least two positions of operation, including a safe position and a fire position. In an example embodiment, the selector switch 500 may be restricted in rotational motion outside of the at least two positions by mechanical design and/or an integrated interlocking feature (e.g., threaded stopper block, spring plunger, etc.).

Figure 2:
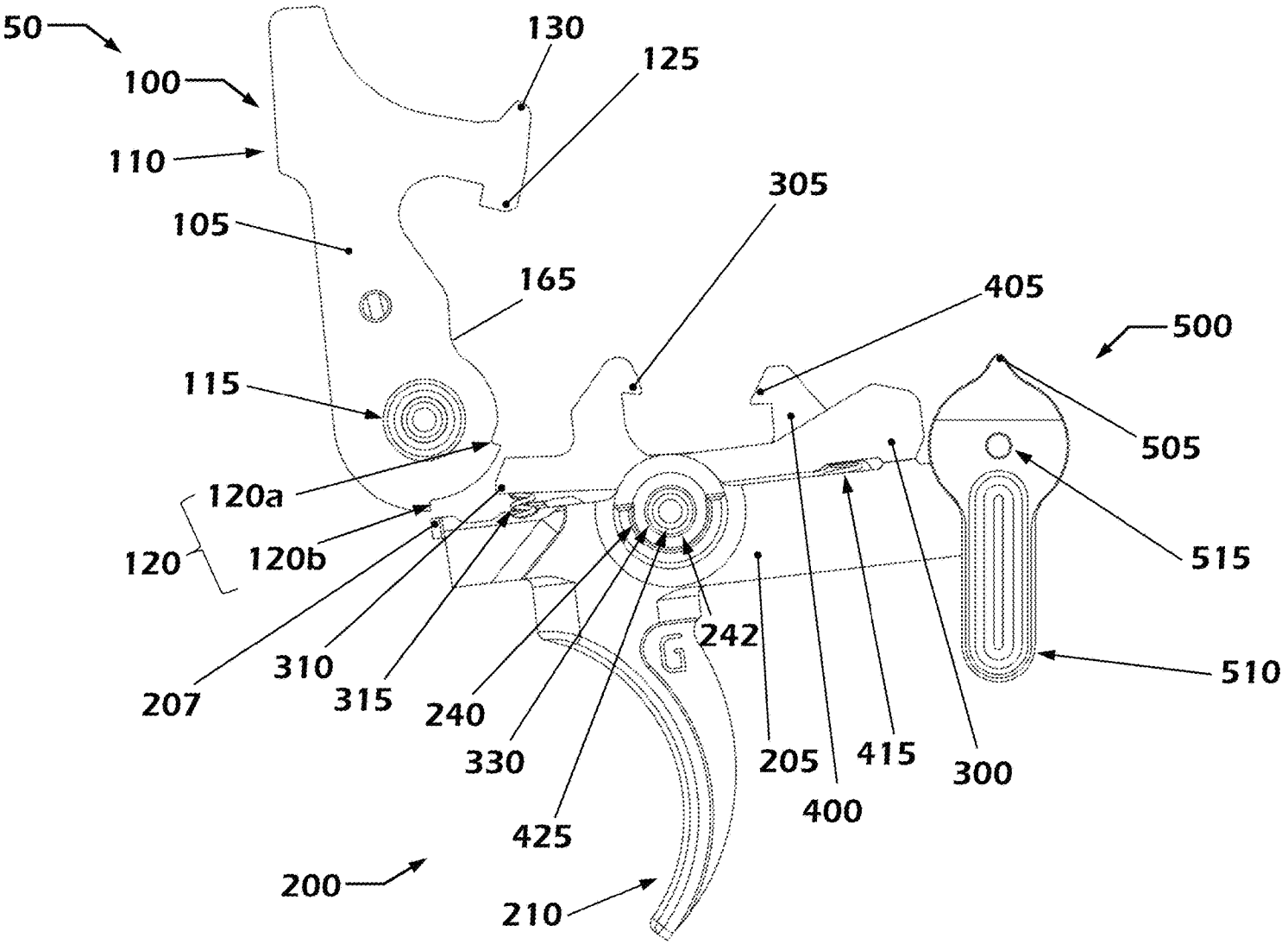
FIG. 2 illustrates a side view of a trigger assembly in accordance with various embodiments of the present disclosure.
Figure 3:
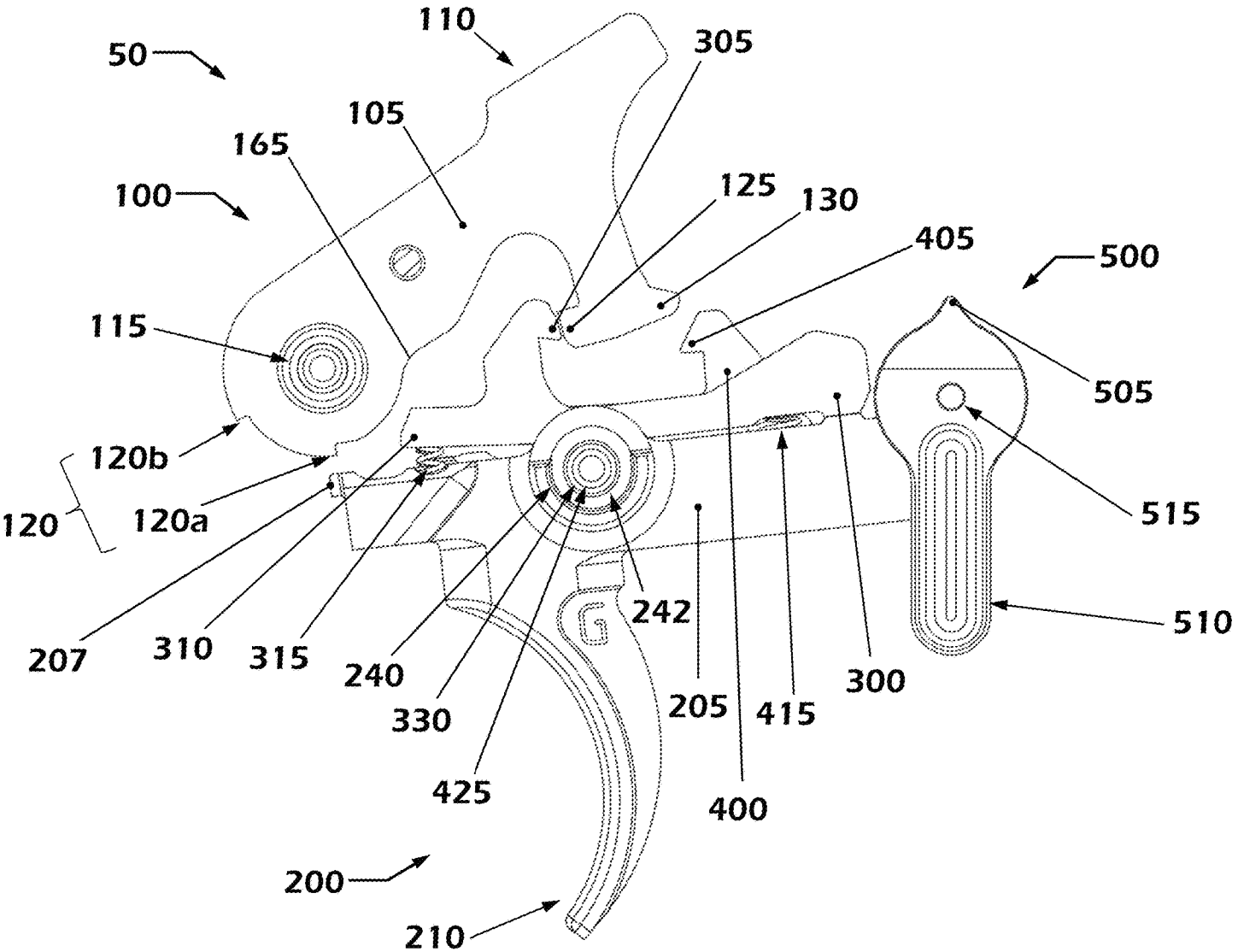
FIG. 3 illustrates a side view of a trigger assembly in accordance with various embodiments of the present disclosure.

In the embodiment depicted in FIG. 1, the trigger assembly 50 is in a cocked orientation with the selector switch disabled (e.g., ready-to-fire, armed). In the depicted embodiment, a hammer scar hook 125 is in contact with the trigger tower hook 305, preventing the release of the hammer spring (e.g., hammer spring 135 shown in FIGS. 8A-8C) and hammer 105. Pulling the trigger lever 210 to a designed distance from rest in the opposing direction of the force of the trigger spring (e.g., trigger spring 220 shown in FIGS. 13A-13B) may rotate the trigger tower 300 to a point where the trigger tower hook 305 is no longer in contact with the hammer sear hook 125. In result, the hammer spring may be released, forcing the hammer 105 to pivot about the hammer pivot pin 115 until the hammer strike plate 110 has contacted a firing pin as shown in the embodiment of FIG. 2. In an example embodiment, the hammer strike plate is configured to contain a firing pin. In the embodiments shown in FIGS. 3-4, the hammer 105 may be re-cocked by rotating the hammer 105 until the hammer sear 125 reengages the trigger tower hook 305. As depicted in FIGS. 3-4, the trigger tower hook 305 is configured to rotate counter-clockwise (in the illustrated orientation) in response to the force of the hammer 105 and allow the hammer sear 125 to pass when the selector switch 500 is in both the fire position (e.g., as shown in FIG. 3) and in the safe position (e.g., as shown in FIG. 4). As shown in FIG. 4, the lower trigger body 205 is held by the selector switch 500 when in the safe position, such that the trigger tower 300 rotates without rotating the lower trigger body 205. In some embodiments, the range of motion of the trigger tower 300 relative to the lower trigger body 205 may be at least the distance needed to allow the hammer tongue 122 to clear the trigger tower hook 305 and engage the underside of the trigger tower hook.

Figure 5:
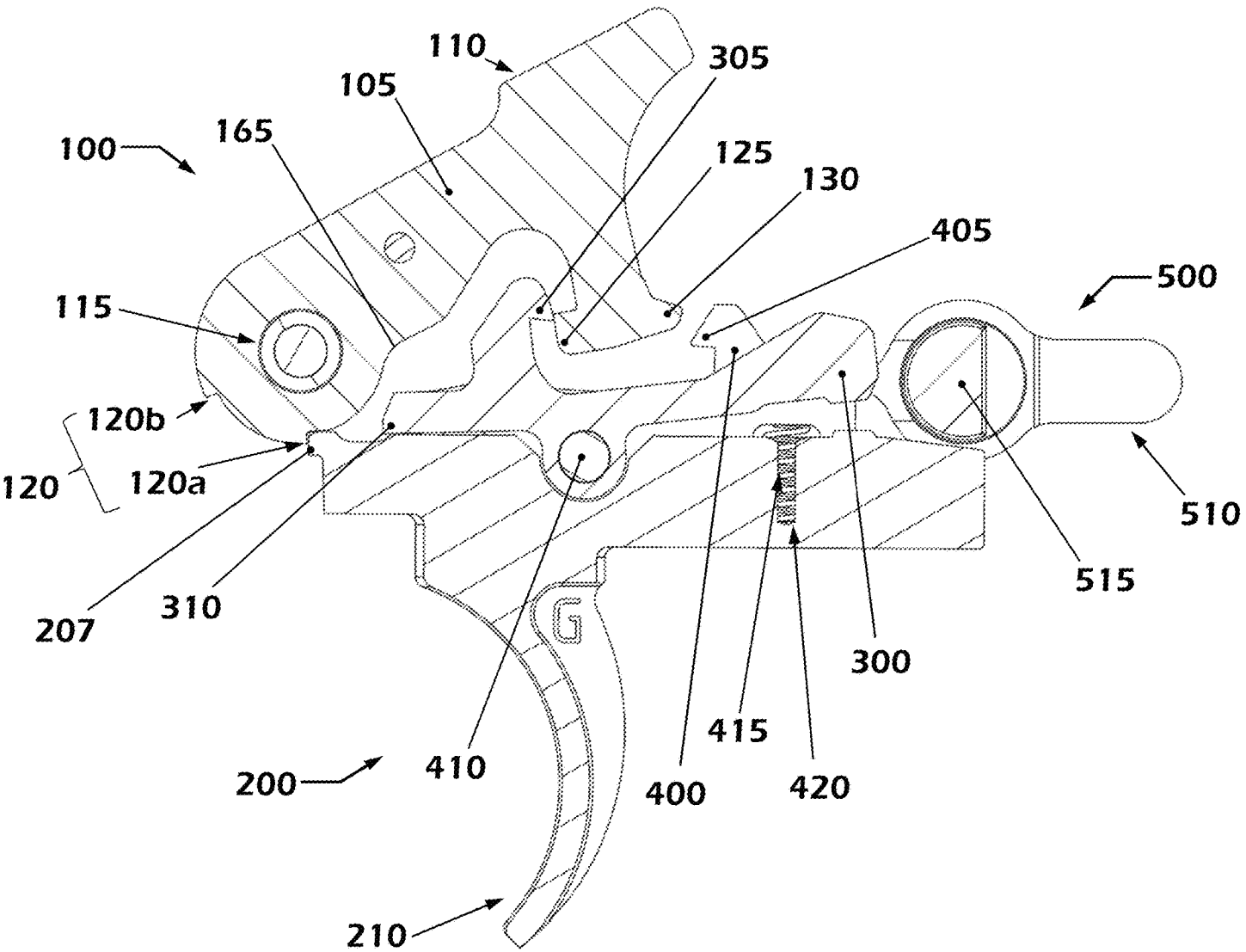
FIG. 5 illustrates a cross-sectional side view of a trigger assembly in accordance with various embodiments of the present disclosure.

FIG. 5 provides a cross-sectional side view of a trigger assembly 50 taken down a center of the trigger assembly. FIG. 5 depicts the selector switch 500 in the safe position and the hammer 105 rotating the trigger tower 300 during re-cocking in accordance with various example embodiments of the present disclosure.

In various example embodiments, the selector switch 500 may be rotated between at least the safe position (shown in FIG. 5) and a fire position via the selector switch lever 510. As shown in FIG. 5, the selector switch pin 515 may include a D-shaped cross-section configured to allow different maximum angles of rotation of the lower trigger body 205 when the selector switch 500 is in different positions. In the embodiment shown in FIG. 5, the safe position is shown with a thicker portion of the selector switch pin 515 oriented towards the lower trigger body 205, which thereby prohibits rotation of the lower trigger body to a point where the firearm discharges. The selector switch lever 510 may be rotated downward to a fire position to orient the shallow side of the D-shaped selector switch pin 515 towards the lower trigger body 205, which may allow the lower trigger body to rotate sufficiently far to discharge the firearm.

In some embodiments, the disconnector may catch and/or apply a force to the hammer disconnector hook 130 during different portions of the cycling process as is used with traditional two-stage triggers. In the depicted embodiment, the disconnector 400 may be configured to rotate relative to the lower trigger body 205 and the trigger tower 300. In the depicted embodiment, a disconnector spring 415 may apply a rotational force to the disconnector 400 from a side opposite the trigger pivot pin 410 from the nose 207 of the lower trigger body 205 (e.g., to apply a force in a counter-clockwise direction relative to the orientation shown in FIG. 5). In various example embodiments, the lower trigger body 205 may include a disconnector spring perch 420. The disconnector spring perch 420 may be configured to support the disconnector spring 415. The disconnector spring 415 may provide a spring force to maintain a desired orientation of the disconnector 400 with the disconnector 400 rotated as far counter-clockwise (relative to the orientation shown in FIG. 5) as possible while allowing the disconnector to deflect and rotate relative to the lower trigger body during cycling when needed.

In various example embodiments, a hammer assembly 100 may be located at the forwardmost point of the lower trigger body 205 towards the muzzle end of the firearm. The forward direction of the trigger assembly may be in a muzzle direction of the firearm along a common, vertical plane with the spring forces against both the hammer assembly 100 and trigger subassembly 200. In various example embodiments, a selector switch 500 is located at the rearmost point of the lower trigger body 205 towards a buttstock end of the firearm.

Figure 6:
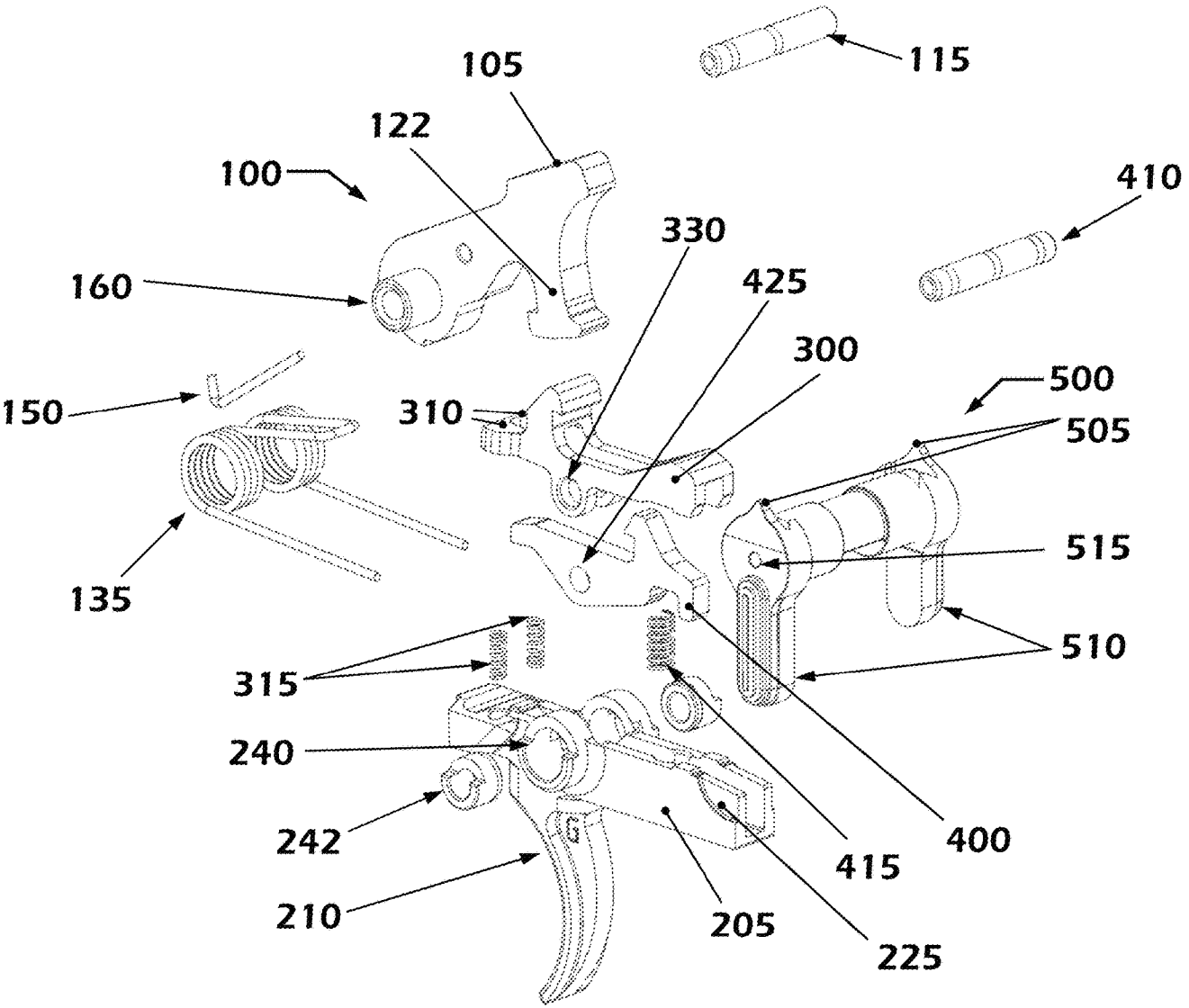
FIG. 6 illustrates a detailed exploded view of a trigger assembly in accordance with various embodiments of the present disclosure.

FIG. 6 provides a detailed exploded view of a trigger assembly 50 in accordance with various example embodiments of the present disclosure. In an example embodiment, the trigger pivot pin 410 facilitates a concentric connection of the lower trigger body 205, trigger tower 300, and disconnector 400, via the respective trigger pivot pin opening 240, trigger tower pivot pin opening 330, and disconnector pivot pin opening 425. In some embodiments, the trigger assembly 50 may include a trigger bushing 242 configured to engage the trigger pivot pin 410. In the depicted embodiments, two trigger bushings 242 are disposed in each of the respective sides of the trigger pivot pin opening 240. In some embodiments, the features depicted as the separate trigger pivot pin opening 240 and trigger bushings 242 may be a single, integral piece of material. In some embodiments, the hammer assembly 100 may pivot about a hammer pivot pin 115 which may be inserted through the opening of a hammer pivot flange 160 as shown in FIG. 6. The hammer pivot pin 115 may be oriented parallel to and offset from the trigger pivot pin 410 to facilitate the operations discussed herein. In an example embodiment, a hammer alignment pin 150 is used to secure the hammer pivot pin 115 together within the hammer 105. In an example embodiment, the structure of the firearm receiver may support the pivot pins described herein on either end and may at least partially prevent the various trigger assembly 50 components from separating.

Figure 7:
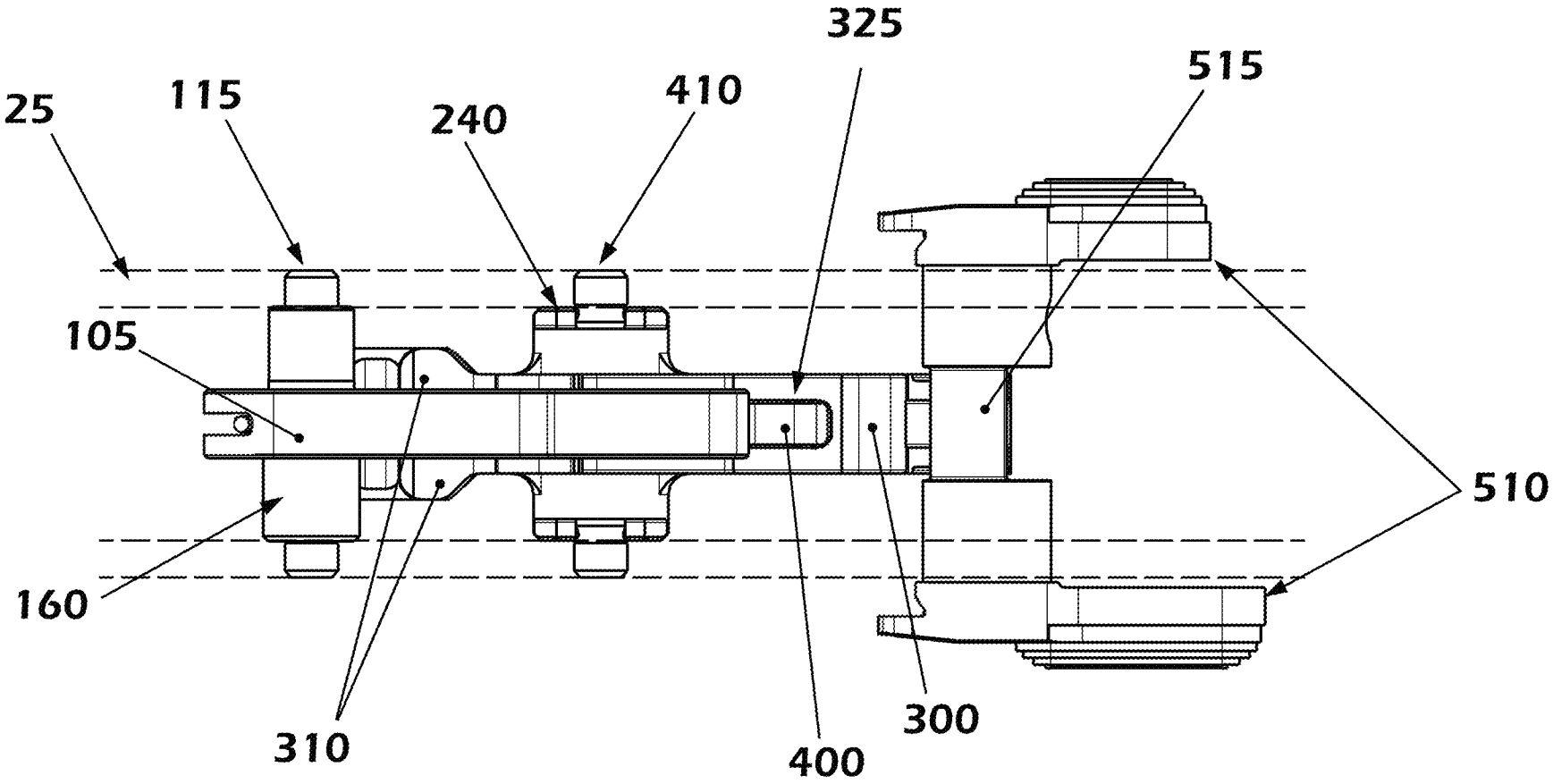
FIG. 7 illustrates a top view of a trigger assembly in accordance with various embodiments of the present disclosure.

FIG. 7 provides a top view of a trigger assembly 50 in accordance with various example embodiments of the present disclosure. In various example embodiments, the trigger assembly 50 is in the cocked position, where a hammer sear hook 125 is latched into a trigger tower hook 305. A selector switch 500 is in the disabled position, allowing the trigger subassembly 200 to pivot following user input, is provided. In an example embodiment, the selector switch 500 may include a selector switch directional indicator 505 and a selector switch lever 510 on each side of the selector switch pin 515. As illustrated, the pins 115, 410, 515 engage a receiver wall 25 of the firearm.

Exemplary Hammer Assembly

Figure 8C:
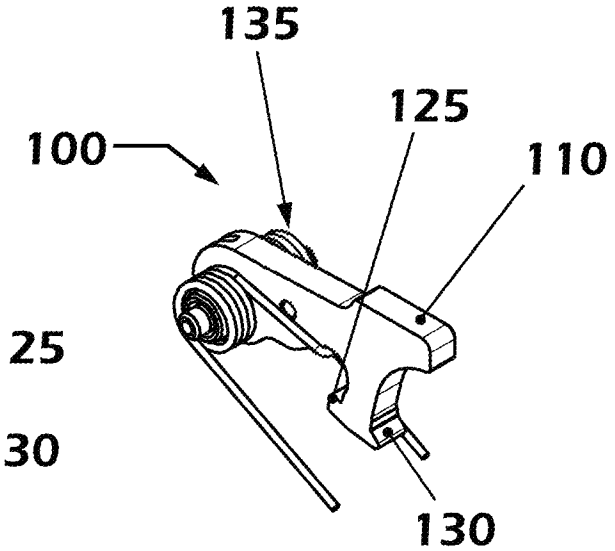
FIG. 8C illustrates a top-isometric view of a hammer assembly in accordance with various embodiments of the present disclosure.
Figure 8B:
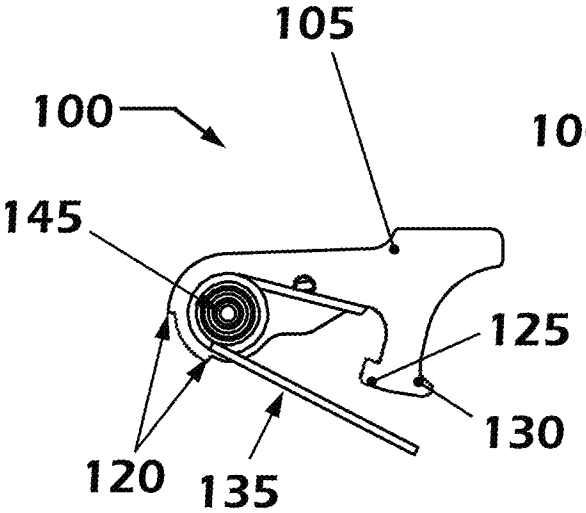
FIG. 8B illustrates a side view of a hammer assembly in accordance with various embodiments of the present disclosure.
Figure 8A:
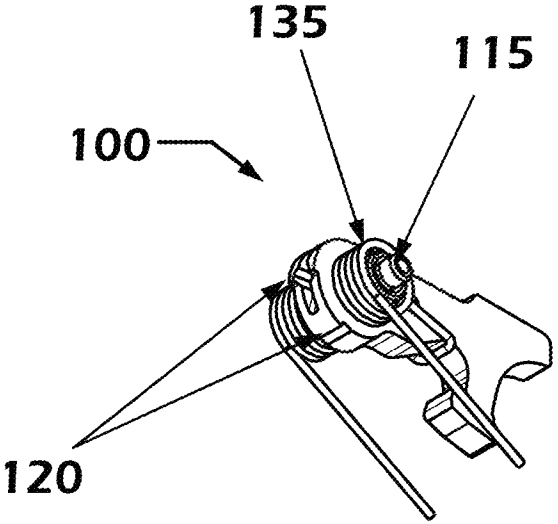
FIG. 8A illustrates a bottom-isometric view of a hammer assembly in accordance with various embodiments of the present disclosure.

FIGS. 8A-8C provide a series of several views of a hammer assembly 100 in accordance with various example embodiments of the present disclosure. FIG. 8A provides a bottom-isometric view of the hammer assembly 100, FIG. 8B provides a side view of the hammer assembly 100, and FIG. 8C provides a top-isometric view of the hammer assembly 100 according to various embodiments. In various example embodiments, the hammer assembly 100 includes a hammer spring 135. In the depicted embodiment, the hammer spring 135 is affixed around the hammer 105 about the hammer pivot flange 160 and the hammer pivot pin 115 on either side of the hammer, like two joined torsion springs. The distal legs of the hammer spring 135 may engage another surface in the firearm (e.g., the trigger pivot pin 410 or a surface within the receiver) to provide a spring force to the hammer 105, forcing the hammer 105 towards a firing pin and cartridge by pivoting the hammer 105 about the hammer pivot flange 160 and the hammer pivot pin 115 when the hammer is released by the trigger subassembly 200. In an example embodiment, the hammer 105 pivots about the hammer pivot flange 160 and the hammer pivot pin 115 in the counterclockwise direction relative to the orientation shown in FIG. 8B.

Figure 9C:
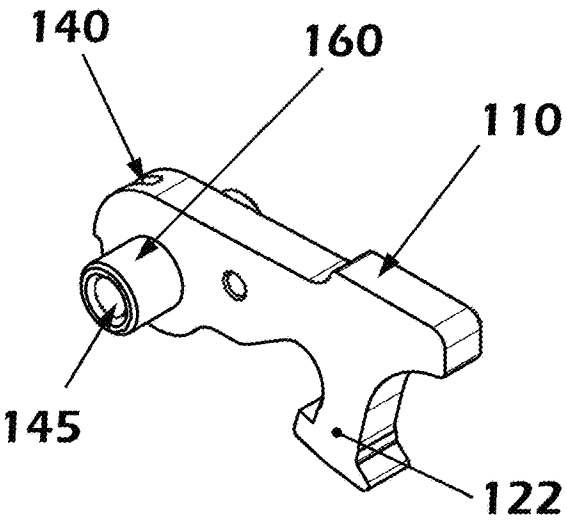
FIG. 9C illustrates a top-isometric view of a hammer in accordance with various embodiments of the present disclosure.
Figure 9B:
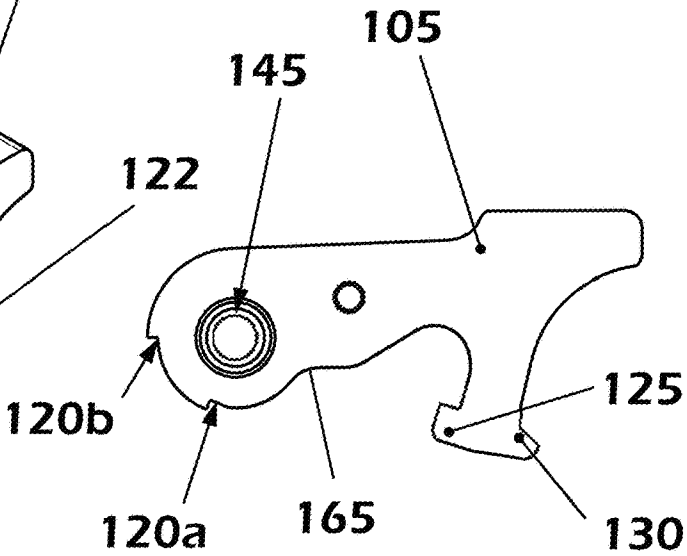
FIG. 9B illustrates a side view of a hammer in accordance with various embodiments of the present disclosure.
Figure 9A:
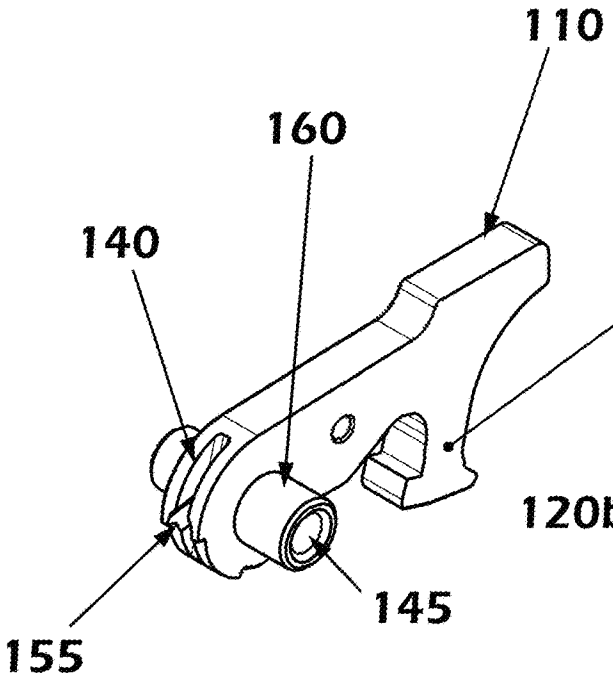
FIG. 9A illustrates a top-isometric view of a hammer in accordance with various embodiments of the present disclosure.

FIGS. 9A-9C provide a series of several isolated views of the hammer 105 in accordance with various example embodiments of the present disclosure. FIG. 9A provides a top-isometric view of the front of the hammer 105, FIG. 9B provides a side view of the hammer 105, and FIG. 9C provides a top-isometric view of the rear of the hammer 105 according to various embodiments. Also with reference to FIGS. 1-5, in various example embodiments, the hammer 105 includes a plurality of hammer sears 120 used to limit the rotation of the hammer 105 about the hammer pivot pin 115. Herein, the hammer sears 120 may be collectively referred to with reference numeral 120 or individually referred to as a first hammer scar 120*a* and a second hammer scar 120*b* (e.g., labeled separately in FIG. 9B). In an example embodiment, the first hammer scar 120*a*, shown in FIGS. 1 and 9B, forms a secondary safety stop for the hammer 105 from pivoting out of the cocked position, for example, in the event the trigger tower 300 releases the hammer 105 prior to the lower trigger body 205 being rotated. In an example embodiment, the second hammer scar 120*b*, shown in FIGS. 2 and 9B, provides a recess into which the nose 207 of the lower trigger body 205 may travel when the hammer is uncocked and thus allowing clearance for rotation of the hammer. The first hammer scar 120*a*, including the ramped surface leading to the first hammer sear when rotating the hammer 105 from the uncocked position towards the cocked position, may further cause the lower trigger body 205 and trigger tower hook 305 to begin to rotate counter-clockwise (relative to the perspective shown in FIGS. 1-5) prior to the trigger tower hook 305 and the hammer sear hook 125 making contact, which may be used in some embodiments to smooth the cocking action of the trigger assembly 50. In some embodiments, the hammer 125 will cause the trigger tower 305 to rotate counter clockwise on the cocking movement if the trigger is not in the pulled position.

In an example embodiment, the hammer scar hook 125 and hammer disconnector hook 130 are integrated into the design of a protrusion from the back of the hammer 105 defining a hammer tongue 122. In an example embodiment, the hammer tongue 122 protrudes into the trigger subassembly 200 to engage with the trigger tower hook 305 and/or the disconnector hook 405 via the respective hammer sear hook 125 and hammer disconnector hook 130.

In various example embodiments, the plurality of hammer sears 120 is configured to rotationally align with a lower trigger nose 207 of the lower trigger body 205 at the respective rotational positions of the hammer. In an example embodiment, the first hammer sear 120*a* of the plurality of hammer sears 120 aligns with the lower trigger nose 207 in an instance in which the hammer 105 is in the cocked position, such that the lower trigger nose 207 is able to rotate into the recess adjacent the sear 120*a*. In an example embodiment, the second hammer sear 120*b* of the plurality of hammer sears 120 is configured to rotationally align with the lower trigger nose 207 of the lower trigger body 205 in an instance in which the hammer is in an uncocked position.

With reference to FIG. 9B and FIGS. 1-5, the hammer 105 may also include a hammer tower nose recess 165 formed along a rear surface of the hammer 105 opposite the hammer strike plate 110. With reference to FIG. 1, the nose 310 of the trigger tower 300 may be permitted by the recess 165 to rotate without contacting the hammer 105. In the depicted embodiment, the recess 165 is disposed on the rear edge surface of the hammer 105 between the pivot pin axis and the hammer tongue 122. As further depicted in FIGS. 9A-9C, the hammer pivot flange 160 may be integrally formed with the rest of the hammer body, such that the hammer pivot flange 160 extends laterally out to either side of the hammer to define the hammer pivot pin opening 145 through which the hammer pivot pin extends. In some embodiments, the hammer pivot flange 160 may extend the width of the interior of the firearm receiver to align and support the hammer within the receiver via the distal ends of the hammer pivot flange 160 contacting opposing internal walls of the receiver.

Figure 10B:
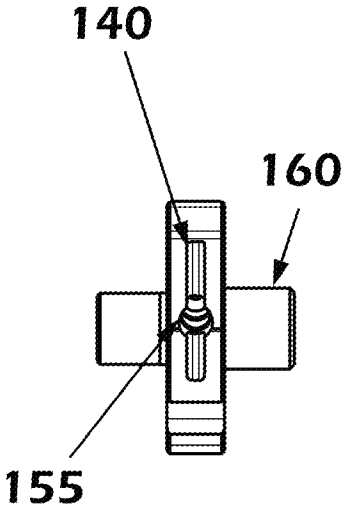
FIG. 10B illustrates a front view of a hammer in accordance with various embodiments of the present disclosure.
Figure 10A:
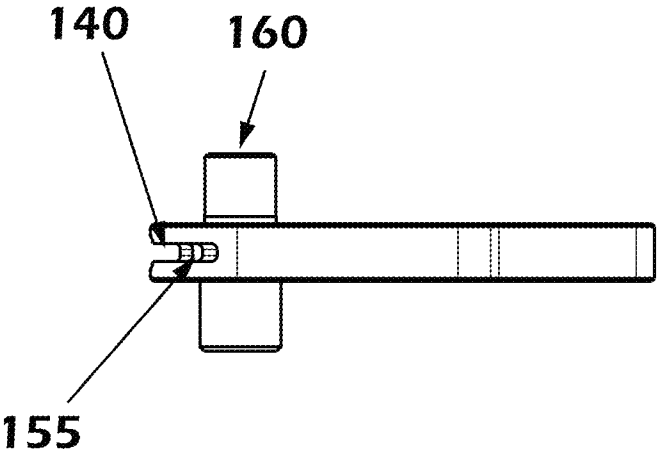
FIG. 10A illustrates a top view of a hammer in accordance with various embodiments of the present disclosure.

FIGS. 10A-10B provide a series of several views of a hammer 105 in accordance with various example embodiments of the present disclosure illustrating an example hammer alignment pin recess 155, an example hammer slot 140, and a hammer pivot flange 160. FIG. 10A provides a top view of the hammer 105 and FIG. 10B provides a front view of the hammer 105 in accordance with various embodiments. In various example embodiments, a hammer pivot pin opening 145 (shown in FIG. 9B) of the hammer pivot flange 160 provides a surface for the hammer 105 to rotate about the hammer pivot pin 115 relative to the firearm receiver. In some embodiments, the hammer pin 115 may be held by a hammer alignment pin 150 as discussed herein. In some embodiments, the hammer 105 may include a hammer slot 140 located on an edge surface of the hammer proximate the hammer pivot pin opening 145. In an example embodiment, an additional hammer alignment pin recess 155 may be configured to receive a hammer alignment pin 150 through the hammer slot 140 to secure the hammer pivot pin 115 relative to the hammer pivot pin opening 145.

Figure 11:
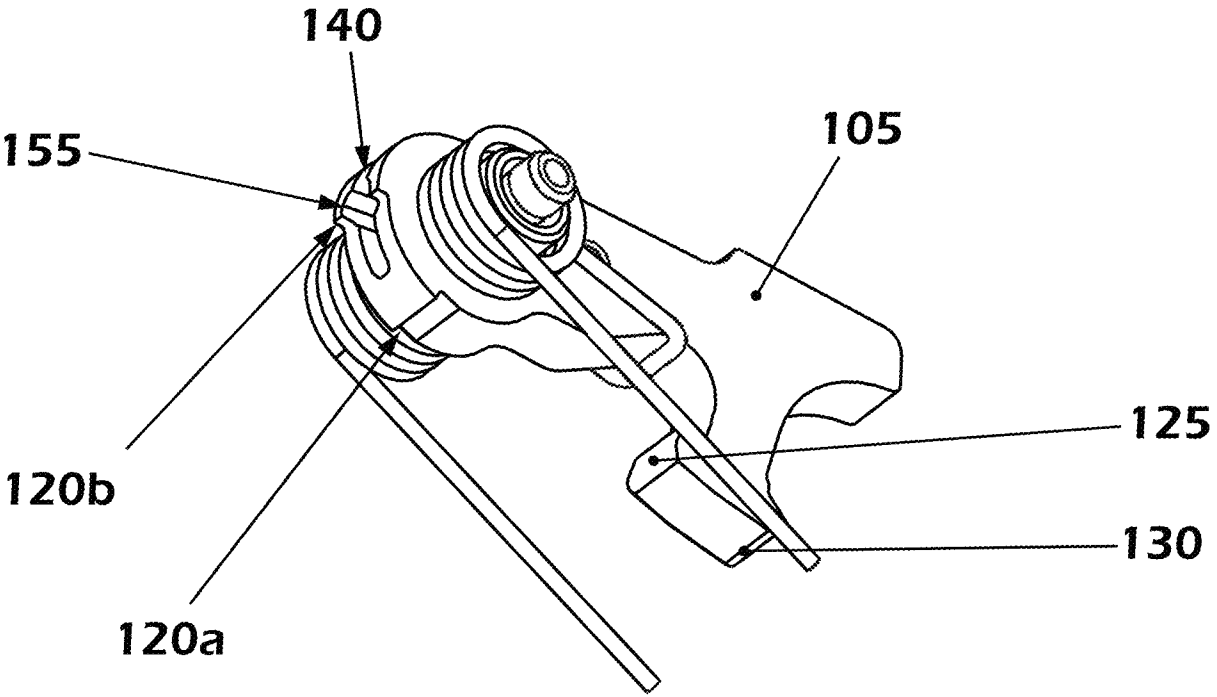
FIG. 11 illustrates a bottom-isometric view of a hammer in accordance with various embodiments of the present disclosure.

FIG. 11 provides a bottom-isometric view of the front of a hammer 105 in accordance with various example embodiments of the present disclosure. In an example embodiment, a hammer alignment pin recess 155 may provide access for the hammer alignment pin 150 to enter the interior of the trigger tower 105 to secure the hammer 105 to the hammer pivot pin 115. For example, the hammer alignment pin 150 may engage a groove and/or hole in the surface of the hammer pivot pin 115. In the depicted embodiment, the hammer slot 140 and hammer alignment pin recess 155 are shown intersecting the second hammer sear 120*b*.

Figure 12:
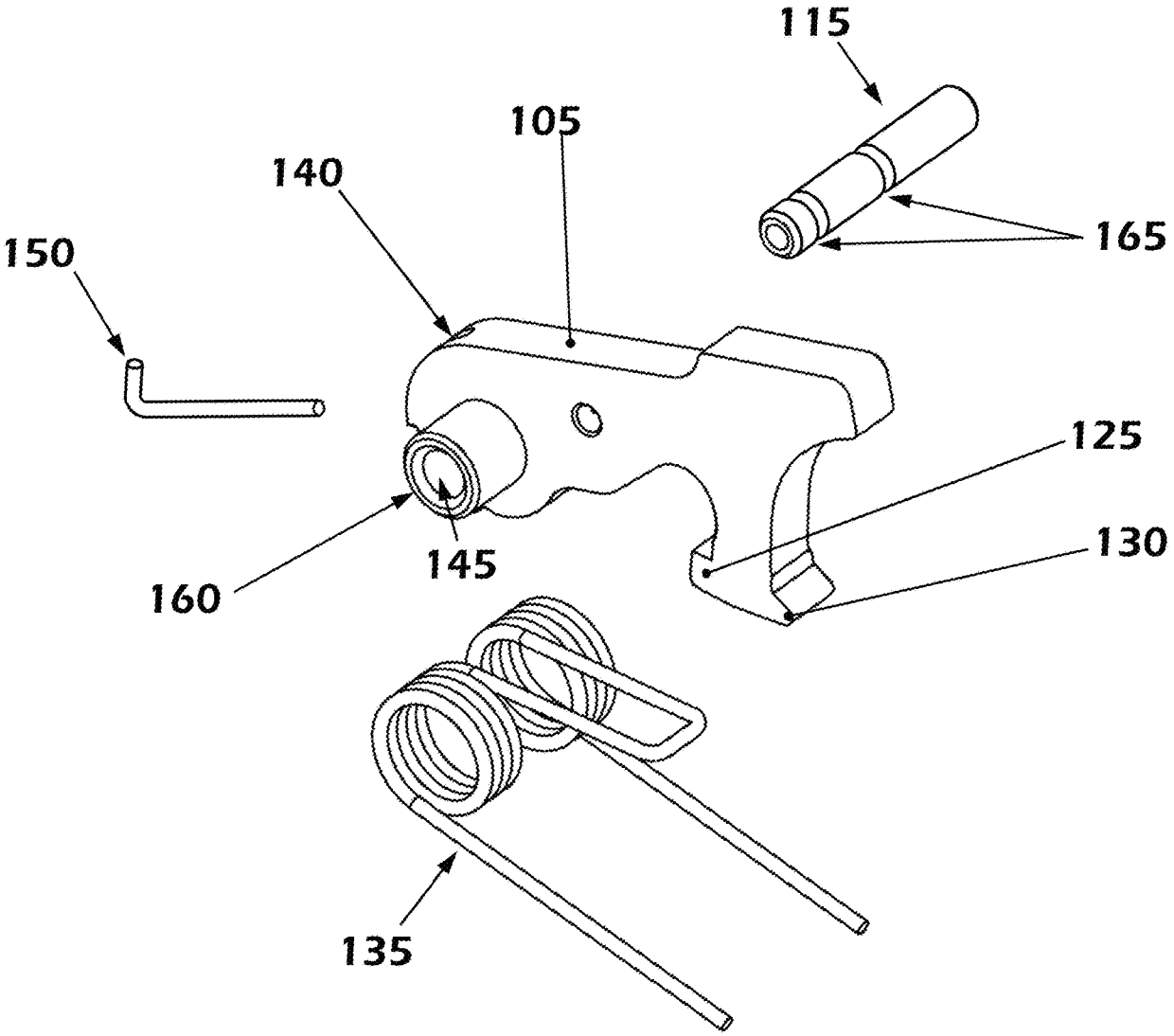
FIG. 12 illustrates a detailed exploded view of a hammer assembly in accordance with various embodiments of the present disclosure.

FIG. 12 provides a detailed exploded view of a hammer assembly 100 in accordance with various example embodiments of the present disclosure. In various example embodiments, a hammer pivot pin 115 is configured with one or more hammer alignment pin grooves 165 formed circumferentially in a surface thereof. A hammer alignment pin 150 may be placed in the interior of the hammer 105 through the hammer alignment pin recess 155, with the hammer alignment pin groove 165 of the hammer pivot pin 115 engaging the hammer alignment pin 150.

In various example embodiments, a hammer spring 135 is configured similar to two mirrored torsion springs connected together. The hammer spring 135 may be configured to apply a spring force to the hammer 105 about the hammer pivot pin 115 as described herein.

Exemplary Trigger Subassembly

Figure 13B:
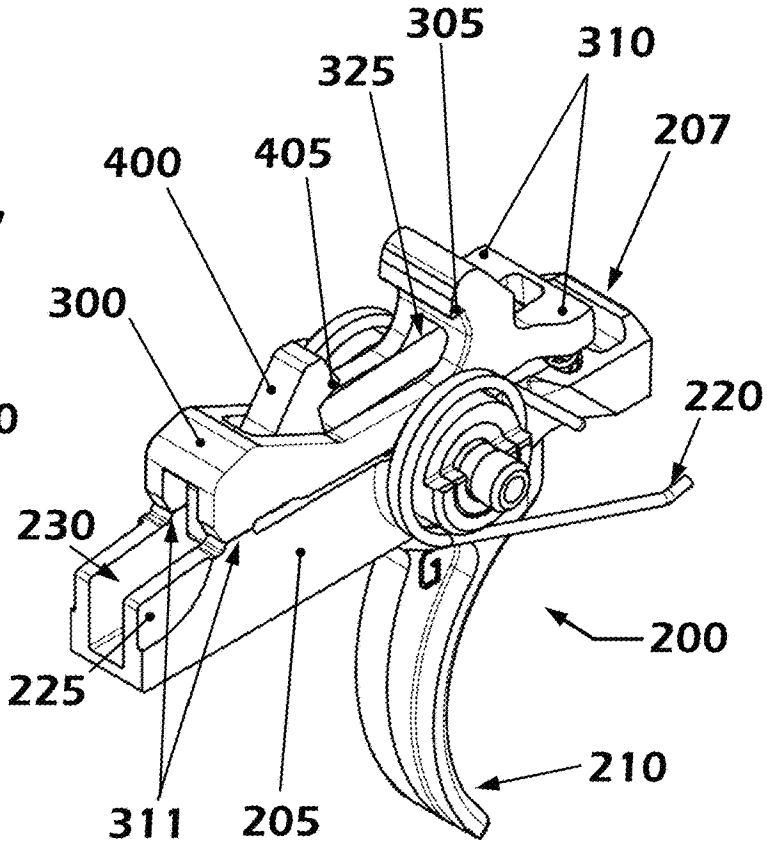
FIG. 13B illustrates a top-isometric view of a trigger subassembly in accordance with various embodiments of the present disclosure.
Figure 13A:
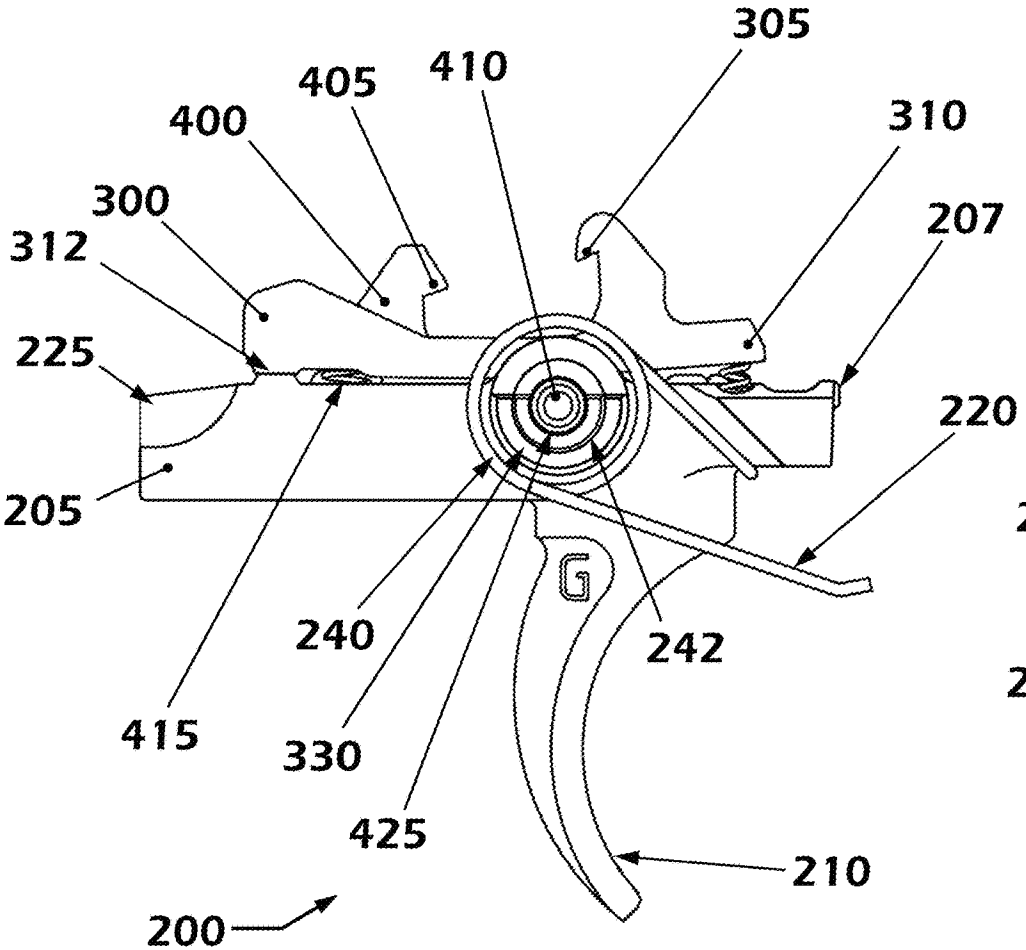
FIG. 13A illustrates a side view of a trigger subassembly in accordance with various embodiments of the present disclosure.

FIGS. 13A-13B provide two views of a trigger subassembly 200 in accordance with various example embodiments of the present disclosure. FIG. 13A provides a side view of the trigger subassembly 200 and FIG. 13B provides a top-isometric view of the rear of the trigger subassembly 200. In various example embodiments, the trigger subassembly 200 may include a lower trigger body 205 and trigger pivot pin 410. The lower trigger body 205 may pivot about an axis of the trigger pivot pin 410 (either with the pin or relative to the pin) following user input onto a trigger lever 210 in a rotational direction opposite the spring force. In the depicted embodiment, the trigger subassembly 200 also comprises a multi-stage (e.g., two piece) trigger tower 300 and disconnector 400 assembly. The trigger tower 300 may pivot about a trigger pivot pin 410 concentric with the rotation of the lower trigger body 205 (e.g., with the pivot pin opening of the trigger tower being disposed inside a trough of the trigger 230). The trigger tower 300 is configured with an inner slot of the trigger tower 325 to provide a cavity for a disconnector 400 to pivot about the trigger pivot pin 410, concentric with the rotation of the lower trigger body 205 and the trigger tower 300. In the depicted embodiment, the inner slot 325 passes under the trigger tower hook 305 and a bridge structure on the rear of the trigger tower 300.

Figures 14A, 14B, 14C:
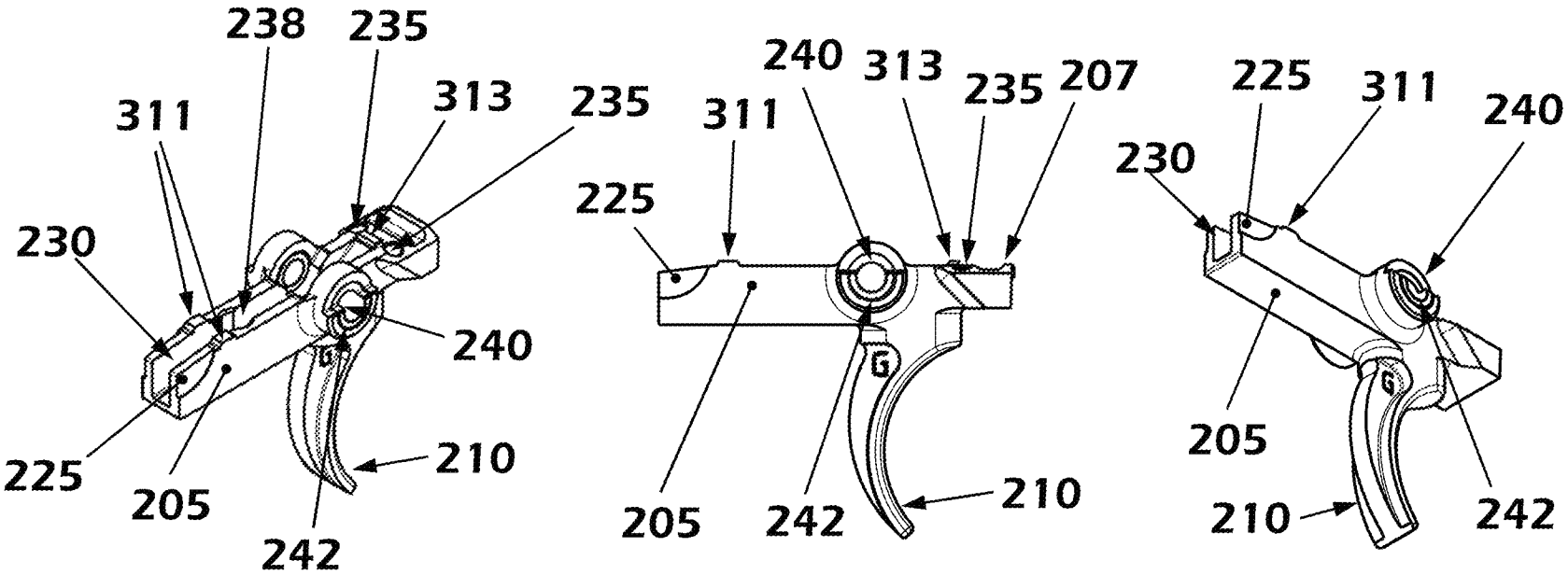
FIG. 14A illustrates a top-isometric view of a lower trigger body in accordance with various embodiments of the present disclosure.
FIG. 14B illustrates a side view of a lower trigger body in accordance with various embodiments of the present disclosure.
FIG. 14C illustrates a bottom-isometric view of a lower trigger body in accordance with various embodiments of the present disclosure.

In various example embodiments, the lower trigger body 205 is configured with a trigger trough 230 to provide a space for portions of the disconnector 400 and trigger tower 300 to pivot about the trigger pivot pin 410 below the topmost surface of the lower trigger body 205. The disconnector 400 may further pivot about the trigger pivot pin 410 within the inner slot 325 of the trigger tower 300. With reference to FIGS. 14A-14C, in various example embodiments, at least one trigger tower spring recess 235 is configured in an upper surface of the lower trigger body 205 to support and/or retain one or more trigger tower spring(s) 315. For example, in the depicted embodiment, a plurality of trigger tower spring recess 235 are provided on either side of the trough 230 between the pivot pin opening 240 and the lower trigger nose 207 to retain the two trigger tower springs 315. For example, in some embodiments, the trigger tower springs 315 may be disposed to either side of a nose 412 (shown in FIGS. 18A-18C) of the disconnector 400 to prevent interference between the rotating components.

In various example embodiments, at least one disconnector spring recess 238 is configured within the design of the lower trigger body 205 to retain a disconnector spring 415. In various example embodiments, at least one disconnector spring recess 238 is formed in the lower trigger body 205 to support and/or retain a disconnector spring 415 therein. With reference to FIG. 5, in an example embodiment, the disconnector spring 415 is configured to apply a force between the lower trigger body 205 and the disconnector 400, retaining the orientation of the disconnector 400 relative to the lower trigger body 205 until the spring force of the disconnector spring 415 is overcome.

In an example embodiment, a trigger tower stop 312 of the trigger tower 300 rests against a first lower trigger body stop 311 when the trigger tower 300 is in a neutral position and the disconnector spring 415 is at a maximum extension within the trigger subassembly 200. In the depicted embodiment shown in FIGS. 13A-13B, the trigger tower 300 includes two trigger tower stops 312 on either side of the inner slot 325 and the lower trigger body 205 includes two first lower trigger body stops 311 on either side of the trough 230. The trigger tower stop(s) 112 and the first lower trigger body stop(s) may be disposed on a rearward, buttstock side of the trigger assembly 200 relative to the trigger pivot pin 410 location.

With reference to FIGS. 16A-17D, in an example embodiment, the trigger tower 300 has at least one trigger tower nose 310. In some embodiments, the trigger tower nose 310 may define one or more recesses 314 configured to receive at least one trigger tower spring 315 therein. In an example embodiment, the trigger subassembly 200 may include a trigger tower nose section 310 and a recess 314 on each side of the inner slot of the trigger tower 325 at the frontmost, muzzle end opposite the trigger tower stop 312.

In various example embodiments, a trigger spring 220 provides a spring force in the counterclockwise direction as oriented in FIG. 13A. In some embodiments, the distal leg(s) of the trigger spring 220 may engage another portion of the firearm (e.g., a portion of the lower receiver) to apply force against the lower trigger body 205. When the trigger lever 210 is pulled against the trigger spring 220 in the clockwise rotational direction relative to the perspective of FIG. 13A, the hammer 105 may release as the trigger tower hook 305 loses contact with the hammer sear hook 125 and the disconnector 400 forces the hammer disconnector hook 130 upward to initiate firing of the cartridge as described with respect to FIGS. 1-5.

FIGS. 14A-14C provide a series of several views of a lower trigger body 205 in accordance with various example embodiments of the present disclosure. FIG. 14A provides a top-isometric view of the front of the lower trigger body 205, FIG. 14B provides a side view of the trigger subassembly 205, and FIG. 14C provides a bottom-isometric view of the front of the lower trigger body 205 in accordance with various embodiments. In an example embodiment, a selector switch engagement portion 225 may define a recess incorporated within the rearmost, buttstock end of the lower trigger body 205 to provide a region for the selector switch 500 to pivot about the selector switch pin 515.

Figure 15A:
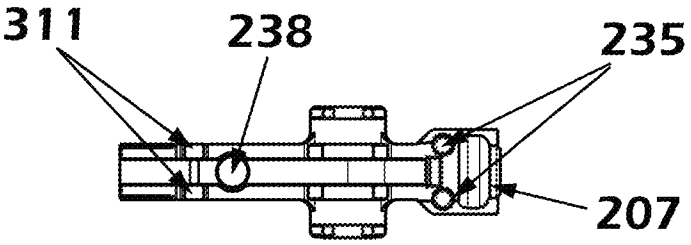
FIG. 15A illustrates a top view of a lower trigger body in accordance with various embodiments of the present disclosure.
Figure 15C:
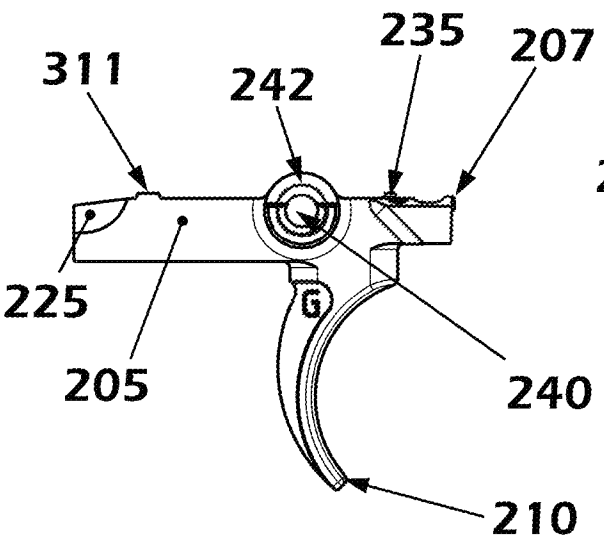
FIG. 15C illustrates a side view of a lower trigger body in accordance with various embodiments of the present disclosure.
Figure 15D:
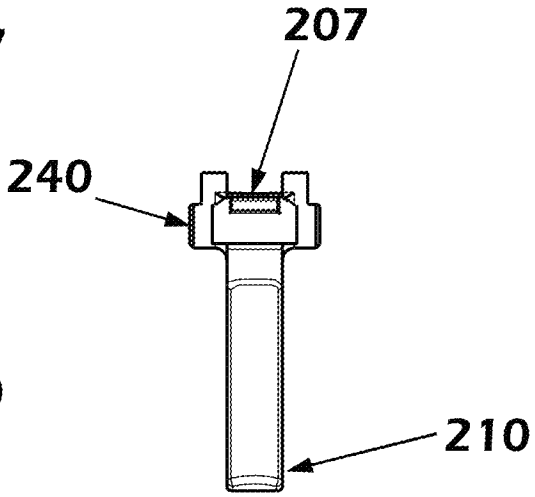
FIG. 15D illustrates a front view of a lower trigger body in accordance with various embodiments of the present disclosure.
Figure 15B:
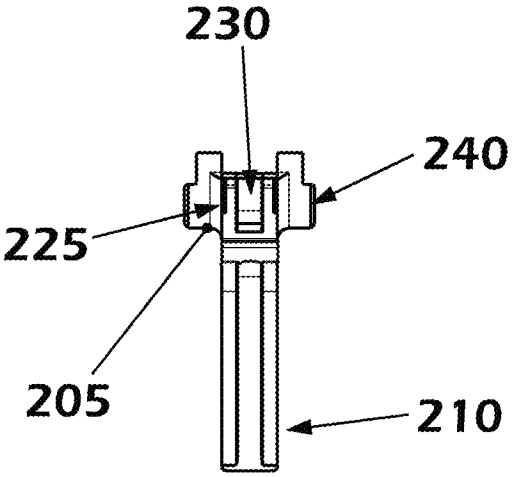
FIG. 15B illustrates a back view of a lower trigger body in accordance with various embodiments of the present disclosure.

FIGS. 15A-15D provide a series of several views of a lower trigger body 205 in accordance with various example embodiments of the present disclosure. FIG. 15A provides a top view of the lower trigger body 205, FIG. 15B provides a back view of the lower trigger body 205, FIG. 15C provides a side view of the lower trigger body 205, and FIG. 15D provides a front view of the lower trigger body 205 in accordance with various embodiments. In an example embodiment, the first lower trigger body stop 311 defines a contact surface of the lower trigger body 205 that may be configured to limit the angular pivoting distance of the trigger tower 300 relative to the lower trigger body 205.

In the depicted embodiment, the lower trigger body 205 is configured with at least one disconnector spring recess 238 to receive at least one disconnector spring 415 therein. The lower trigger body 205 may include at least one trigger tower spring recess 235 to receive at least one trigger tower spring 315 therein on each side of the inner slot 325. In the depicted embodiment, the trigger tower spring recesses 235 are depicted on an opposite side of the pivot pin opening 240 from the disconnector spring recess 238. In some embodiments, the lower trigger body 205 may include a second lower trigger body stop 313 configured to limit the rotational movement of the disconnector 400.

Figure 16C:
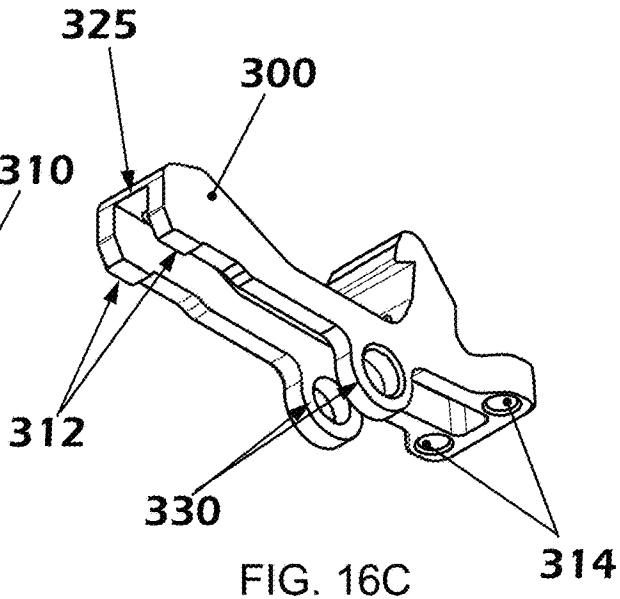
FIG. 16C illustrates a bottom-isometric view of a trigger tower in accordance with various embodiments of the present disclosure.
Figure 16B:
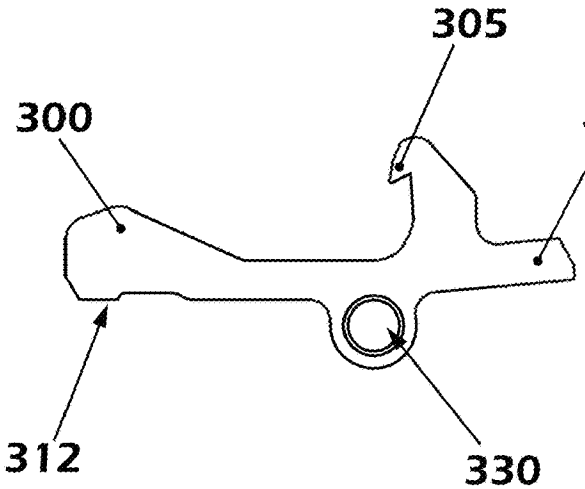
FIG. 16B illustrates a side view of a trigger tower in accordance with various embodiments of the present disclosure.
Figure 16A:
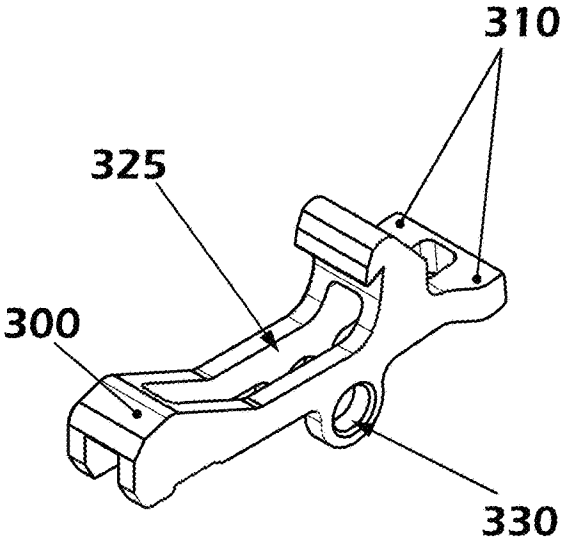
FIG. 16A illustrates a top-isometric view of a trigger tower in accordance with various embodiments of the present disclosure.
Figure 17A:
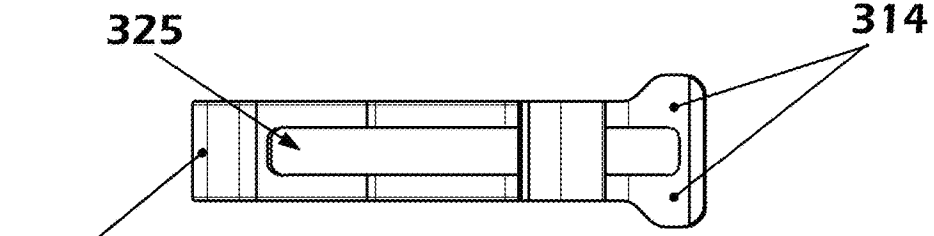
FIG. 17A illustrates a top view of a lower trigger body in accordance with various embodiments of the present disclosure.
Figure 17B:
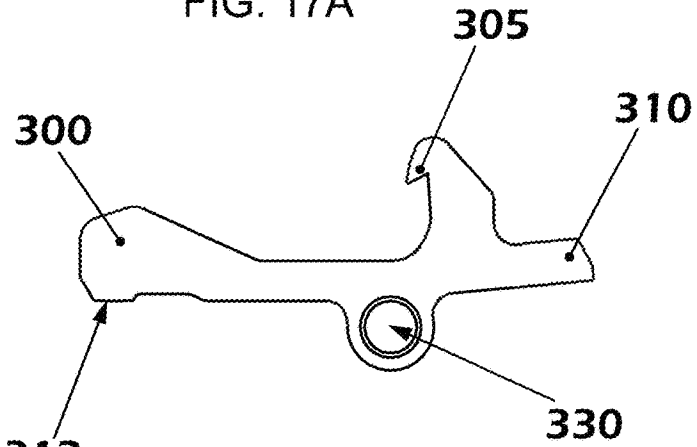
FIG. 17B illustrates a side view of a lower trigger body in accordance with various embodiments of the present disclosure.
Figure 17C:
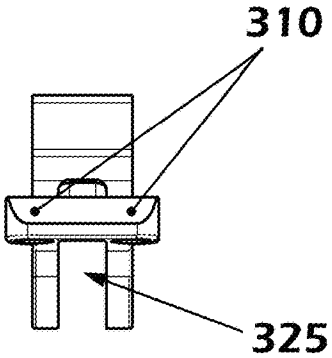
FIG. 17C illustrates a front view of a lower trigger body in accordance with various embodiments of the present disclosure.
Figure 17D:
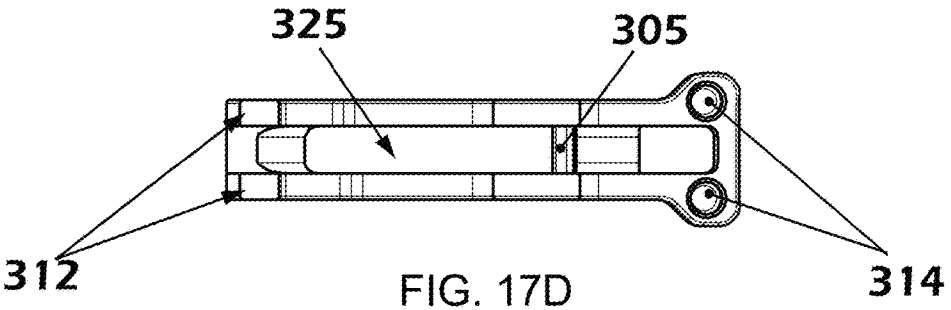
FIG. 17D illustrates a bottom view of a lower trigger body in accordance with various embodiments of the present disclosure.

FIGS. 16A-17D provide a series of several views of a trigger tower 300 in accordance with various example embodiments of the present disclosure. FIG. 16A provides a top-isometric view of the rear of the trigger tower 300, FIG. 16B provides a side view of the trigger tower 300, and FIG. 16C provides a bottom-isometric view of the rear of the trigger tower 300 in accordance with various embodiments. FIG. 17A provides a top view of the trigger tower 300, FIG. 17B provides a side view of the trigger tower 300, FIG. 17C provides a front view of the trigger tower 300, and FIG. 17D provides a bottom view of the trigger tower in accordance with various embodiments. In an example embodiment, the trigger tower stop 312 defines a contact surface of the trigger tower 300 that is configured to limit the angular pivoting distance of the trigger tower 300 relative to the lower trigger body 205. In an example embodiment, an inner slot of the trigger tower 325 is configured to provide a cavity for the disconnector 400 to pivot about the trigger pivot pin 410. In an example embodiment, the trigger tower pivot pin opening 330 may comprise two openings on either side of the inner slot of the trigger tower 325.

Figure 18C:
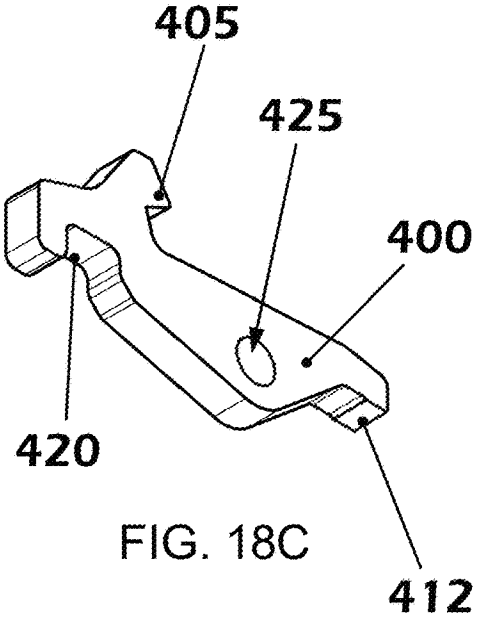
FIG. 18C illustrates a bottom-isometric view of a disconnector in accordance with various embodiments of the present disclosure.
Figure 18B:
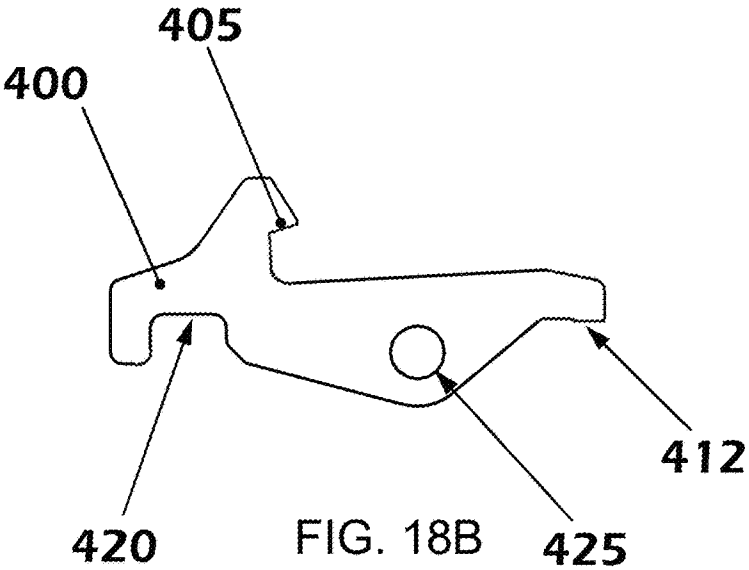
FIG. 18B illustrates a side view of a disconnector in accordance with various embodiments of the present disclosure.
Figure 18A:
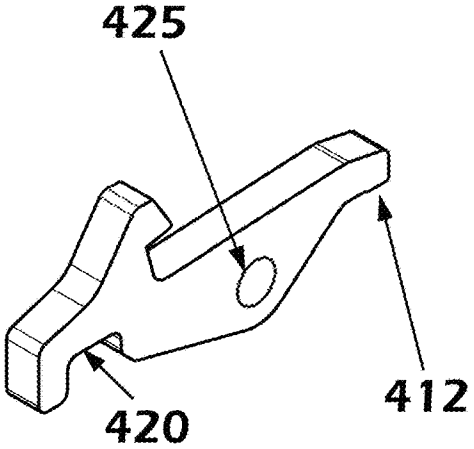
FIG. 18A illustrates a top-isometric view of a disconnector in accordance with various embodiments of the present disclosure.

FIGS. 18A-18C provide a series of several views of a disconnector 400 in accordance with various example embodiments of the present disclosure. FIG. 18A provides a top-isometric view of rear of the disconnector 400, FIG. 18B provides a side view of the disconnector 400, and FIG. 18C provides a bottom-isometric view of the rear of the disconnector 400 in accordance with various embodiments. In an example embodiment, the disconnector 400 design is configured with a disconnector spring perch 420 at the rearmost end of the disconnector 400. The disconnector spring perch 420 is configured to receive a disconnector spring 415 therein.

In an example embodiment, the disconnector spring 415 provides a spring force in the clockwise direction as shown in FIG. 18B. The disconnector 400 may pivot about a disconnector pivot pin opening 425 until a surface of the disconnector 400 contacts a surface of a lower trigger body 205, for example, via a disconnector stop 412 defining a contact surface. The disconnector stop 412 is configured to limit the angular pivoting distance of the disconnector 400 relative to the lower trigger body 205 at the second lower trigger body stop 313 (shown in FIGS. 14A-14C). In various example embodiments, the disconnector pivot pin opening 425 is configured throughout the entire cross-section of the disconnector 400.

Also with reference to FIGS. 1-5, the disconnector 400 may include disconnector hook 405 configured to latch onto a hammer disconnector hook 130 (shown in FIG. 11) on a distal side of the hammer tongue 122 when the hammer 105 is forced into a cocked position while the trigger lever 210 is pulled (e.g., during cycling of the bolt carrier group of the firearm). Upon release of the trigger lever 210, the hammer sear hook 125 may engage the trigger tower hook 330 and the disconnector 400 may release the hammer disconnector hook 130 as the lower trigger body 205 rotates back into a neutral, unpulled position. Upon rotation of the lower trigger body 205 during actuation of the trigger lever 210 to fire a cartridge, an upper surface of the disconnector hook 405 may apply a force to at least partially push the hammer sear hook 125 out and initiate the actuation of hammer 105 to strike the firing pin. In an example embodiment, the disconnector 400 is oriented at least partially within the inner slot 325 of the trigger tower 300 and at least partially within the trigger trough 230 of the lower trigger body 205.

Figure 19:
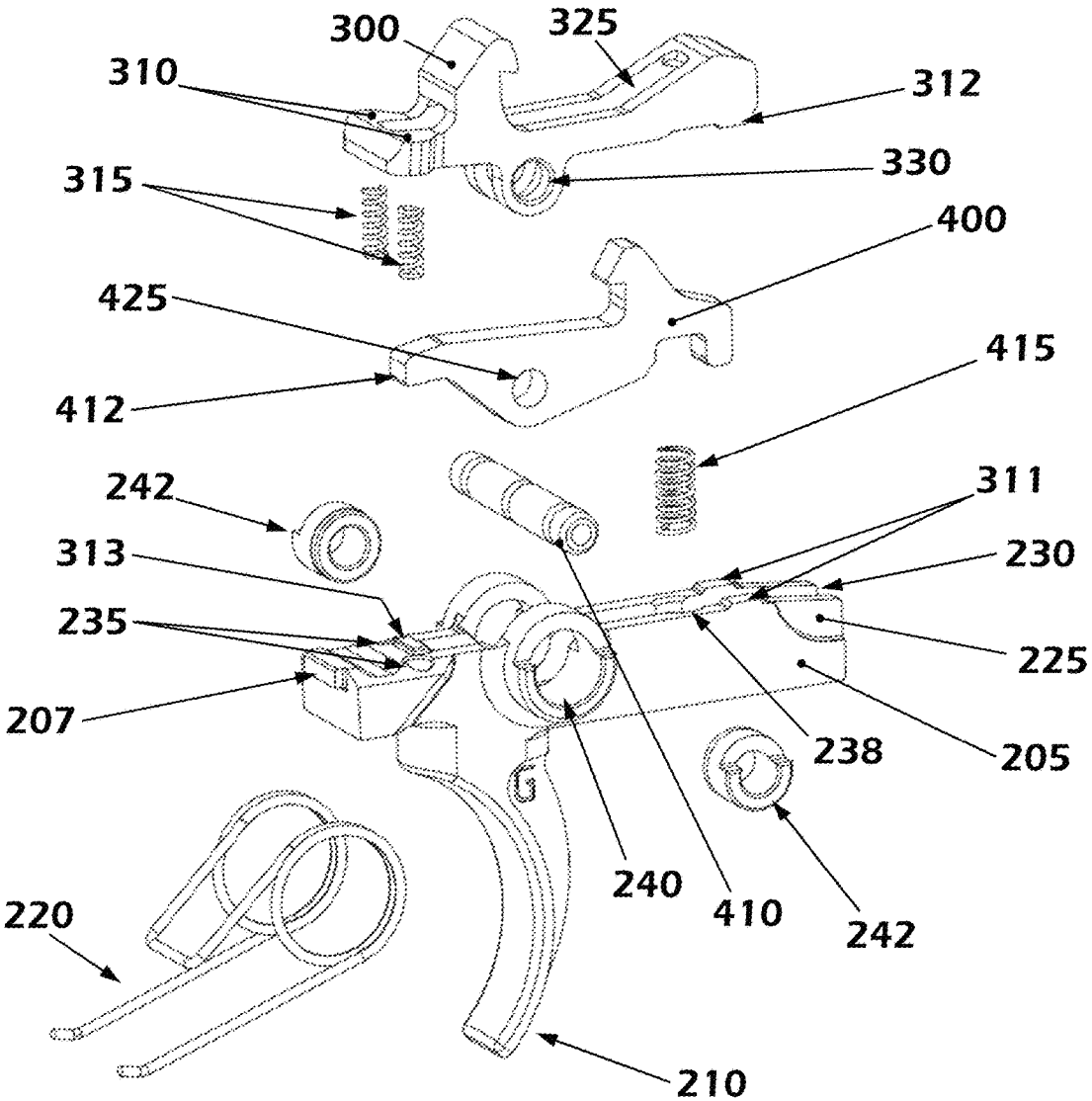
FIG. 19 illustrates a detailed exploded view of a trigger subassembly in accordance with various embodiments of the present disclosure.

FIG. 19 provides a vertically-aligned detailed exploded view of a trigger subassembly 200 in accordance with various example embodiments of the present disclosure. In various example embodiments, a lower trigger body 205, trigger tower 300, and disconnector 400 are pivotably connected via respective openings that engage a trigger pivot pin 410. In an example embodiment, the disconnector 400 is configured to engage the trigger pivot pin 410 at its center, through an inner slot of the trigger tower 325 of the trigger tower 300. The trigger tower may be configured to engage the trigger pivot pin 410 on each side of the disconnector 400 at least partially within the lower trigger body 205. The lower trigger body 205 may be configured to engage the trigger pivot pin 410 proximate the ends of the pin, which ends may engage the wall of the receiver of the firearm. In an example embodiment, the lower trigger body 205, trigger tower 300, and disconnector 400 may respectively have a trigger pivot pin opening 240, trigger tower pivot pin opening 330, and disconnector pivot pin opening 425.

Figure 22:
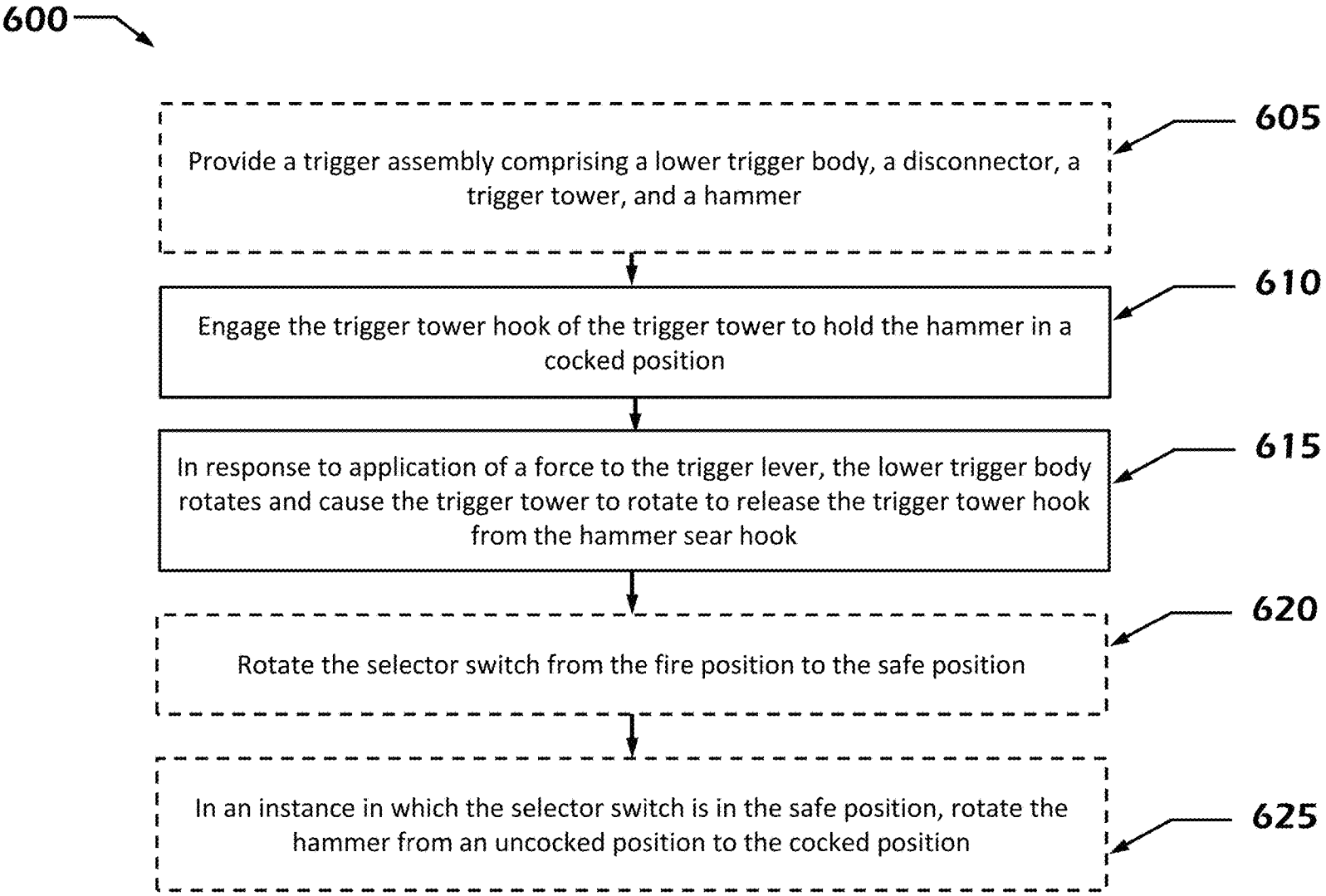
FIG. 22 provides a flowchart illustrating the process for operating a trigger assembly in accordance with various embodiments of the present disclosure.

FIG. 22 provides a flow diagram of an example method 600 for operating a trigger assembly of a firearm. In the depicted embodiment at block 605, a trigger assembly may be provided in accordance with any of the embodiments discussed herein. In some embodiments, the trigger assembly may have previously been provided prior to the operation of the trigger assembly. The trigger assembly may include a lower trigger body, a disconnector, a trigger tower, and a hammer. At block 610, the method may include engaging the trigger tower hook of the trigger tower to hold the hammer in a cocked position. At block 615, a user may apply a force to a trigger lever of the trigger. In response to application of a force to the trigger lever, the lower trigger body may rotate and cause the trigger tower to rotate to release the trigger tower hook from the hammer sear hook, which may cause firing of a cartridge and completion of a firing sequence by the various components of the firearm. In some embodiments, as shown at block 620, the method may include rotating the selector switch from the fire position to the safe position. At block 625, the method may include, in an instance in which the selector switch is in the safe position, rotating the hammer from an uncocked position to the cocked position

CONCLUSION

The embodiments described herein may also be scalable to accommodate various applications such as with respect to different size and configurations of firearms. Various components of embodiments described herein can be added, removed, reorganized, modified, duplicated, and/or the like as one skilled in the art would find convenient and/or necessary to implement a particular application in conjunction with the teachings of the present disclosure. Moreover, specialized features, characteristics, materials, components, and/or equipment may be applied in conjunction with the teachings of the present disclosure as one skilled in the art would find convenient and/or necessary to implement a particular application in light of the present disclosure.

Many modifications and other embodiments of the present disclosure set forth herein will come to mind to one skilled in the art to which this disclosure pertains having the benefit of the teachings presented in the foregoing descriptions and the associated drawings. Therefore, it is to be understood that the present disclosure is not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated, in light of the present disclosure, that different combinations of elements and/or functions can be provided by alternative embodiments without departing from the scope of the appended claims. In this regard, for example, different combinations of elements and/or functions than those explicitly described above are also contemplated as can be set forth in some of the appended claims. Although specific terms are employed herein, they are used in a generic and descriptive sense only and not for purposes of limitation.

The invention claimed is:

1. A hammer for a trigger assembly, the hammer comprising:

a hammer sear hook configured to engage a trigger tower hook of a trigger tower of the trigger assembly to hold the hammer in a cocked position; and two hammer sears each defining a sear recess into which a lower trigger nose of a lower trigger body of the trigger assembly is configured to be inserted, wherein the hammer defines a pin recess that intersects a hammer sear of the two hammer sears.

2. The hammer of claim 1, wherein a first sear of the two hammer sears is configured to rotationally align with the lower trigger nose of the lower trigger body in an instance in which the hammer is in the cocked position, and wherein a second sear of the two hammer sears is configured to rotationally align with the lower trigger nose of the lower trigger body in an instance in which the hammer is in an uncocked position.

3. The hammer of claim 1, wherein the hammer comprises a ramped surface that extends between the two hammer sears.

4. The hammer of claim 3, wherein the ramped surface is configured to cause the lower trigger body and the trigger tower hook to rotate as the hammer moves from an uncocked position towards the cocked position.

5. The hammer of claim 1, wherein the hammer comprises a hammer tongue that is a protrusion on a back of the hammer, wherein the hammer sear hook is integrated into the protrusion.

6. The hammer of claim 5, wherein:

the hammer comprises a recess formed along a rear surface of the hammer, the recess is positioned between a first sear of the two hammer sears and the hammer tongue, and the recess is configured to allow the trigger tower to rotate without contacting the hammer.

7. The hammer of claim 1, wherein the hammer comprises a hammer strike plate and defines a recess along a rear surface opposite the hammer strike plate, and wherein a trigger tower nose of the trigger tower is configured to at least partially enter the recess.

8. The hammer of claim 1, wherein the hammer is configured to allow a selector switch of the trigger assembly to be movable between a safe position and a fire position both when the hammer is in the cocked position and when the hammer is in an uncocked position.

9. The hammer of claim 1, wherein the hammer is configured to be moveable from an uncocked position to the cocked position when a selector switch of the trigger assembly is in a safe position.

10. The hammer of claim 9, wherein the hammer is configured to rotate the trigger tower when moving from the uncocked position to the cocked position to allow the hammer sear hook to pass around and engage the trigger tower hook.

11. The hammer of claim 1, wherein the hammer is configured to rotate the trigger tower when moving from an uncocked position to the cocked position without causing the lower trigger body to rotate.

12. The hammer of claim 1, wherein a first sear of the two hammer sears is closer to the hammer sear hook than a second sear of the two hammer sears.

13. A trigger assembly for a firearm, the trigger assembly comprising a hammer, the hammer comprising:

a hammer sear hook configured to engage a trigger tower hook of a trigger tower of the trigger assembly to hold the hammer in a cocked position; and two hammer sears each defining a sear recess into which a lower trigger nose of a lower trigger body of the trigger assembly is configured to be inserted, wherein the trigger assembly is configured such that the hammer is moveable from an uncocked position to the cocked position when a selector switch of the trigger assembly is in a safe position.

14. The trigger assembly of claim 13, wherein the hammer comprises a ramped surface that extends between the two hammer sears, and wherein the ramped surface is configured to cause the lower trigger body and the trigger tower hook to rotate as the hammer moves from an uncocked position towards the cocked position.

15. The trigger assembly of claim 13, wherein the hammer is configured to allow a selector switch of the trigger assembly to be movable between a safe position and a fire position both when the hammer is in the cocked position and when the hammer is in an uncocked position.

16. A method of operating a hammer of a trigger assembly, wherein the hammer comprises a hammer sear hook and two hammer sears that each define a sear recess, and wherein the method comprises:

rotating the hammer to a cocked position in an instance in which a selector switch of the trigger assembly is in a safe position, wherein when the hammer is in the cocked position, (i.) the hammer sear hook is engaged with a trigger tower hook of a trigger tower of the trigger assembly and (ii.) a first sear of the two hammer sears is rotationally aligned with a lower trigger nose of a lower trigger body; and rotating the hammer to an uncocked position, wherein when the hammer is in the uncocked position, a second sear of the two hammer sears is rotationally aligned with the lower trigger nose of the lower trigger body.

17. The method of claim 16, wherein when the hammer rotates from the uncocked position towards the cocked position, a ramped surface that extends between the two hammer sears causes the lower trigger body and the trigger tower hook to rotate.

18. The method of claim 16, further comprising:

moving a selector switch of the trigger assembly from a fire position to a safe position in an instance in which the hammer is in the cocked position;

moving the selector switch of the trigger assembly from the fire position to the safe position in an instance in which the hammer is in the uncocked position;

moving the selector switch of the trigger assembly from the safe position to the fire position in an instance in which the hammer is in the cocked position; and moving the selector switch of the trigger assembly from the safe position to the fire position in an instance in which the hammer is in the uncocked position.

19. The trigger assembly of claim 13, further comprising the trigger tower, wherein the trigger tower hook of the trigger tower is configured to rotate in response to the force of the hammer moving from the uncocked position to the cocked position to allow the hammer sear hook to pass over the trigger tower hook of the trigger tower.

* * * * *